US005279931A

United States Patent [19]

Bagchi et al.

[11] Patent Number: 5,279,931

[45] Date of Patent: Jan. 18, 1994

[54] POLYMER CO-PRECIPITATED COUPLER DISPERSION

[75] Inventors: Pranab Bagchi, Webster; Steven J. Sargeant, Honeoye Falls; James T. Beck, Rochester; Brian Thomas, Fairport, all of N.Y.

[73] Assignee: Eastman Kodak Company, Rochester, N.Y.

[21] Appl. No.: 692,408

[22] Filed: Apr. 26, 1991

Related U.S. Application Data

[62] Division of Ser. No. 543,910, Jun. 26, 1990, Pat. No. 5,091,296.

[51] Int. Cl.[5] ..... G03C 7/396; G03C 7/388

[52] U.S. Cl. ..... 430/449; 430/546; 430/627; 430/631; 252/310; 252/351; 252/364; 252/589; 252/600

[58] Field of Search ..... 430/495, 546, 548, 449, 430/627, 631; 8/501, 900; 252/589, 600, 364, 351, 310; 524/556

[56] References Cited

U.S. PATENT DOCUMENTS

| | | | |
|---|---|---|---|
| 2,772,163 | 11/1956 | Tong | 430/546 |
| 2,852,386 | 9/1958 | Tong | 430/546 |
| 4,120,725 | 10/1978 | Nakazyo et al. | 430/546 |
| 4,127,499 | 11/1978 | Chen et al. | 252/201.17 |
| 4,133,687 | 1/1979 | Chen et al. | 430/546 |
| 4,198,478 | 4/1980 | Yoneyama et al. | 430/449 |
| 4,199,363 | 4/1980 | Chen | 430/512 |
| 4,203,716 | 5/1980 | Chen | 430/207 |
| 4,214,047 | 7/1980 | Chen | 430/448 |
| 4,247,627 | 1/1981 | Chen | 430/512 |
| 4,291,113 | 9/1981 | Minamizono et al. | 430/202 |
| 4,358,533 | 11/1982 | Tokitou et al. | 430/512 |
| 4,368,258 | 1/1983 | Fujiwhara et al. | 430/493 |
| 4,490,461 | 12/1984 | Webb et al. | 430/510 |
| 4,569,905 | 2/1986 | Mukunoki et al. | 430/546 |
| 4,724,197 | 2/1988 | Matejec et al. | 430/377 |
| 4,728,599 | 3/1988 | Krishnamurthy | 430/546 |
| 4,933,270 | 6/1990 | Bagchi | 430/546 |
| 4,957,857 | 9/1990 | Chari | 430/543 |
| 4,970,139 | 11/1990 | Bagchi | 430/449 |
| 4,996,431 | 2/1991 | Bagchi et al. | 430/546 |

FOREIGN PATENT DOCUMENTS

| | | |
|---|---|---|
| 542135 | 6/1957 | Canada . |
| 0256531 | 2/1988 | European Pat. Off. . |
| 0374837 | 6/1990 | European Pat. Off. . |
| 1193349 | 5/1970 | United Kingdom . |
| 1456278 | 11/1976 | United Kingdom . |

OTHER PUBLICATIONS

*Emulsion Polymerization,* Blackley, 1975, pp. 1-7, 34 and 35.

*Experiments on Polymer Science,* Collins et al., 1973, pp. 27-37.

*Polymer Colloids II,* Fitch, 1978, pp. 225-263.

Research Disclosure, Nov. 1976, Item No. 15131, Mowrey et al.

Research Disclosure, Dec. 1977, Item No. 16468, Priest.

*Primary Examiner*—Lee C. Wright

*Attorney, Agent, or Firm*—Paul A. Leipold

[57] ABSTRACT

This invention describes a process of coprecipitating a photographic material such as a dye-forming coupler inside a base ionizable polymeric particle. Preparation of such a dispersion is performed by providing a first flow comprising a solution of a surfactant in water containing a polymer ionizable by base, providing a second flow comprising a water miscible solvent, base, water, and the photographic material, then mixing the said first and said second flow and immediately neutralizing the mixed flow to precipitate the photographic material inside the polymer particles forming a fine particle colloidal dispersion of the photographic material. The polymer dispersions of the invention are characterized by high photographic activity and high dye-stability in some cases.

11 Claims, 7 Drawing Sheets

POLYMER CO-PRECIPITATED COUPLER DISPERSION

Figure 1:
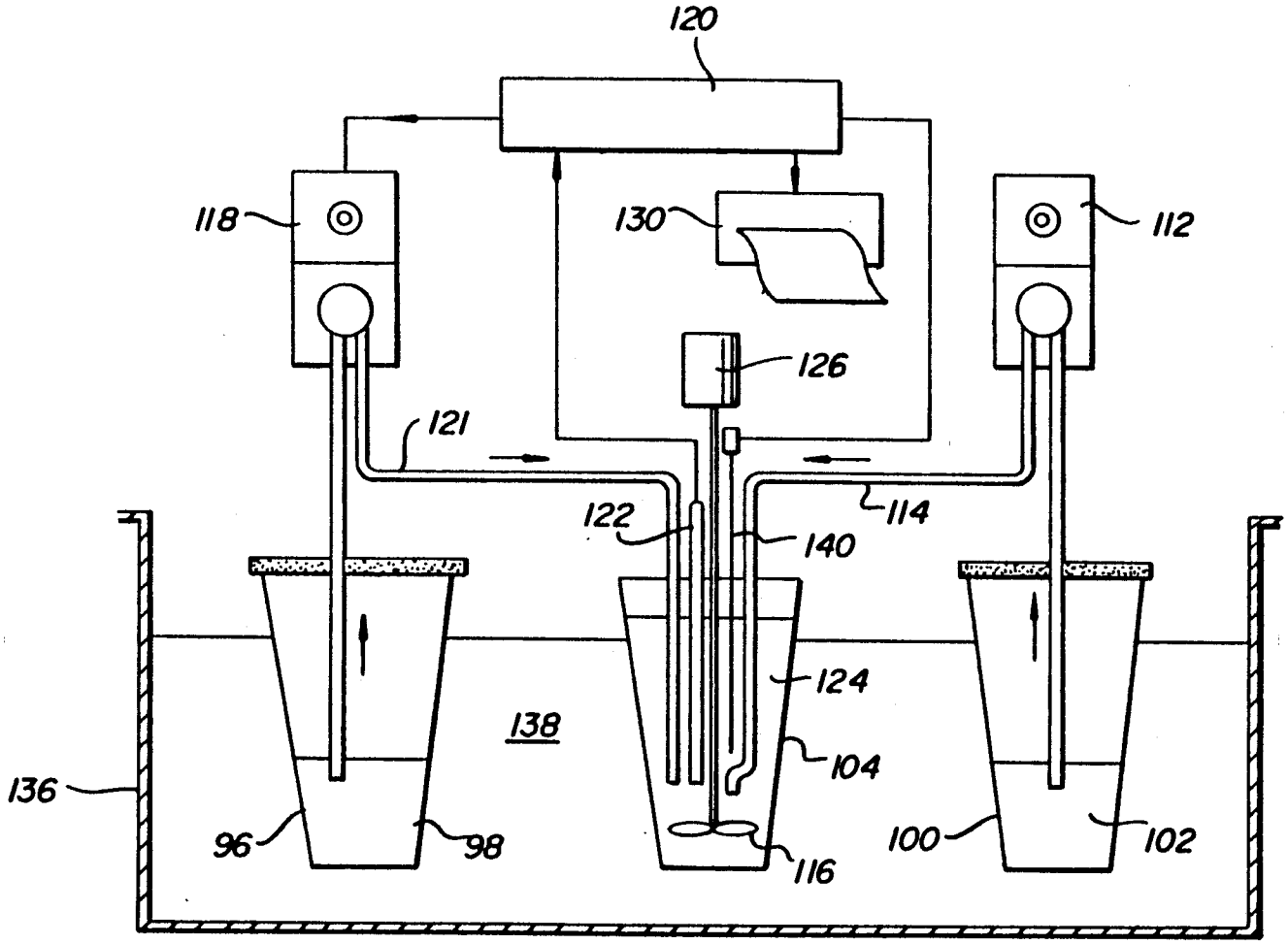

This is a divisional of application Ser. No. 543,910, filed Jun. 26, 1990, now U.S. Pat. No. 5,091,296.

TECHNICAL FIELD

This invention relates to the co-precipitation of coupler dispersions with polymers that have base ionizable or negatively charged groups. The coupler is dissolved in base and a water miscible solvent. A polymer latex with surfactant is ionized by base. These two solutions are then mixed in a stream and co-precipitated to form fine particle dispersions by immediate neutralizing using an acid in a mixing device. In such a precipitated dispersion the coupler precipitates inside the latex to form the dispersion particles, that have high photographic activity.

BACKGROUND ART

R-1 Townsley et al., U.K. Patent 1,193,349.

R-2 W. J. Priest, *Research Disclosure,* December, 1977, "Process for Preparing Stable Aqueous Dispersion of Certain Hydrophobic Materials," pp. 75–80.

R-3 T. J. Chen et al. (Kodak), U.S. Pat. Nos. 4,199,363; 4,214,047; 4,133,687; 4,127,499; 4,203,716; 4,247,627; and 4,127,499.

R-4 L. K. J. Tong (Kodak), U.S. Pat. Nos. 2,852,386 and 2,772,163.

R-5 0. Takahashi, (Fuji), European Patent Application 0,256,531.

R-6 R. Matcjeck (Gaevert), German Patent 3,520,845.

R-7 T. C. Webb et al. (Ciba-Geigy), U.S. Pat. No. 4,490,461.

R-8 K. Nakazyo et al., (Fuji), U.S. Pat. No. 4,120,725.

R-9 M. Yoneyama et al., (Fuji), U.S. Pat. No. 4,198,478.

R-10 J. Minamizono et al., (Fuji), U.S. Pat. No. 4,291,113

R-11 Y. Mukunoki et al., (Fuji), U.S. Pat. No. 4,569,905.

R-12 R. G. Mowrey et al., "Color Dispersions in Synthetic Polymer Vehicles," *Research Disclosure,* 15131, p. 42–43 (1976).

R-13 K. Tokitou et al., (Konishiroku), U.S. Pat. No. 4,358,533.

R-14 N. Fujiwhara et al., (Konishiroku), U.S. Pat. No. 4,368,258.

R-15 L. K. J. Tong, (Kodak), Canada 542,135.

R-16 Mitsubishi Paper Mill, Great Britain 1,456,278

R-17 P. Bagchi et al., "Preparation of Low Viscosity Small-Portable Photographic Disperions in Gelatin," U.S. patent application Ser. No. 366,397.

R-18 B. Chu, "Laser Light-Scattering," Academic Press, 1974, New York.

R-19 Anonymous, "Photographic Silver Halide Emulsions, Preparations, Addenda, Processing and Systems," *Research Disclosure,* 308, p. 933–1015 (1989).

R-20 T. H. James, "Theory of Photographic Processes," 4th Ed., McMillan (1977).

R-21 T. Brandrup et al., "Polymer Handbook," John Wiley, New York (1974).

R-22 P. Bagchi et al., "Methods of Forming Stable Dispersions of Photographic Materials," U.S. patent application Ser. No. 297,005.

It has been known in the photographic arts to precipitate photographic materials, such as couplers, from solvent solution. The precipitation of such materials can generally be accomplished by a shift in the content of a water miscible solvent and/or a shift in pH. The precipitation by a shift in the content of water miscible solvent is normally accomplished by the addition of an excess of water to a solvent solution. The excess of water, in which the photographic component is insoluble, will cause precipitation of the photographic component as small particles. In precipitation by pH shift, a photographic component is dissolved in a solvent that is either acidic or basic. The pH is then shifted such that acidic solutions are made basic or basic solutions are made acidic in order to precipitate particles of the photographic component which is insoluble at that pH. United Kingdom Patent 1,193,349-Townsley et al. (R-1) discloses a process wherein an organic solvent, aqueous alkali solution of a color coupler is mixed with an aqueous acid medium to precipitate the color coupler. It is set forth that the materials can either be utilized immediately, or gelatin can be added to the dispersion and chilled and remelted for use at a later date. In an article in *Research Disclosure,* December, 1977, entitled "Process for Preparing Stable Aqueous Dispersions of Certain Hydrophobic Materials", pages 75–80, by William J. Priest (R-2), it is disclosed that color couplers can be formed by precipitation of small particles from solutions of the couplers in organic auxiliary solvents. However, many coupler dispersions prepared in this manner are photographically very inactive compared to conventional dispersions prepared by milling procedures that contain coupler solvents.

It has been shown that when coupler molecules are imbibed into latex particles by dissolving the coupler in a water-miscible solvent, adding this to the latex and removing the solvent, the resultant dispersion produces adequate photographic activity (R-3 and R-4) for photographic utility. It seems that the polymer latex acts as a coupler solvent; however, such loading procedure requires very large quantities of solvent, which makes this procedure very expensive and hazardous for industrial production. In general such procedure is limited to a load of 3 part coupler and 1 part latex polymer. Prior art (R-5) indicates that polymerization or incorporation of a polymer into mechanically ground dispersions with no permanent solvent produces coupler dispersions that give very stable dye images. Also, incorporation of polymer into the photographic layer produces images of high dye stability as indicated in (R-6). Therefore, it is not clear as to whether the polymer needs to remain in the coupler particle or just in the photographic layer to produce the observed dye stability.

In (R-7), Webb et al. describes a process of dispersion preparation by homogenization of a solid solution of a photographic component and a polymer into aqueous gelatin solution by milling procedures. In the process of this invention, a photographic agent and a polymer is dissolved in a solvent. The solvent is then evaporated off to obtain a solid solution. The solid solution is then dispersed in aqueous gelatin by conventional milling procedures. In a specific embodiment this photographic compound is cross-linked to this polymer. This, in some cases is done by a cross-linking agent. The cross-linking may be done via a carboxyl group pendent on the polymer molecule. It is also known that conventional dispersion of photographic couplers can be prepared with some photographic advantages that contain both coupler solvent and a synthetic polyacrylamide polymer (R-8). In an alternate embodiment of this invention some water soluble acrylamide polymers can be added in aqueous phase along with gelatin for achieving added stability. Surfactant like polymers containing —$SO_3H$ groups in phenol formaldehyde resins (R-9, R-11) and in acrylate polymers (R-10) have been used to stabilize milled conventional dispersions. Other polymeric vehicles have also been incorporated in photographic layers as gelatin replacement material (R-12).

Other solvent loading techniques like Chen's (R-3) have been described Tokitou et al. (R-13) and (R-14). (R-13) describes a process and composition where a photographic material is loaded into a polymer particle by using a large volume of water miscible solvent comprising a polymerized oligomeric material. In a special embodiment, the oligomeric material is polymerized in the presence of the photographic component to form a latex loaded composition. The process of latex loading in (R-14) is quite similar to Chen et al. (R-3). Tong (R-15) describes a very inefficient method of loading of couplers into latex dispersion by stirring the coupler for long periods of time with the latex and filtering off the excess coupler. This procedure led to less than 1 g of coupler per 20 g of the latex polymer in many cases. (R-16)-describes loading of ultraviolet radiation absorbing compounds into polymer resin by the use of both permanent and auxiliary solvents in the presence of gelatin.

There are drastic differences between this invention and that of Chen (R-3). In this invention, the coupler is solubilized and the latex is swollen by base and a water miscible solvent, in contrast with Chen's (R-3) process where coupler solubilization and latex swelling are done by a water miscible solvent alone. In the present invention, the impregnation of this latex by the coupler is achieved by the neutralization by acid, whereas in the case of Chen, it is achieved by evaporative removal of the solvent. As Chen's method is a solvent shift method, it requires a large amount of water miscible (auxiliary) solvent. By Chen's (R-3) process the amount of solvent needed is between 15 to 20 times the weight of the coupler to be imbibed. This is a major drawback of Chen's procedure. In Chen's process the maximum loading is 3 parts coupler to 1 part polymer, whereas higher loading would be desirable. Chen's method requires at least 2% by weight of the monomers to be of the type that forms a water soluble polymer. A process that does not have any such requirement would be desirable.

DISCLOSURE OF THE INVENTION

An object of this invention is to provide more highly reactive dispersions of photographic dye-form couplers.

Another object is to provide improved photographic flims.

These and other objectives of this invention are generally accomplished by providing dispersion of photographic dye-forming coupler (or other photographic agent) wherein the coupler is imbibed inside a polymer particle that is ionizable or ionized and swellable by base.

Generally the invention is performed by providing a first flow of water, base, a base swellable polymer latex dispersion, a surfactant and a second flow comprising a water miscible auxiliary solvent, base and the photographic coupler material, bringing together and mixing the said first and the said second flows and then immediately following mixing, neutralizing the said streams to form the dispersion particles. The dispersion particles contain the latex polymer, the photographic material (dye-forming coupler) and the water miscible solvent. The solvent is subsequently washed off by diafiltrations providing particles that only contain essentially the latex polymers and the dye-forming coupler. The size of the dispersion particles are of the same order of magnitude as the particles in the latex dispersion. Such dispersion particles are generally considerably more active than the conventional milled dispersion of the same coupler containing permanent coupler solvent. The latex particles of this invention may have any diameter between 10 nm (0.01 μm) to 800 nm (0.80 μm). The preferred diameters of the latex particles of this invention are below 200 nm or (0.2 μm). The range and the preferred range of diameters of the coupler loaded polymer particles are same as these of the polymer particles themselves.

A BRIEF DESCRIPTION OF THE DRAWINGS

FIG. 1. Equipment for the precipitation of the dispersions of this invention in small scale.

Figure 2:
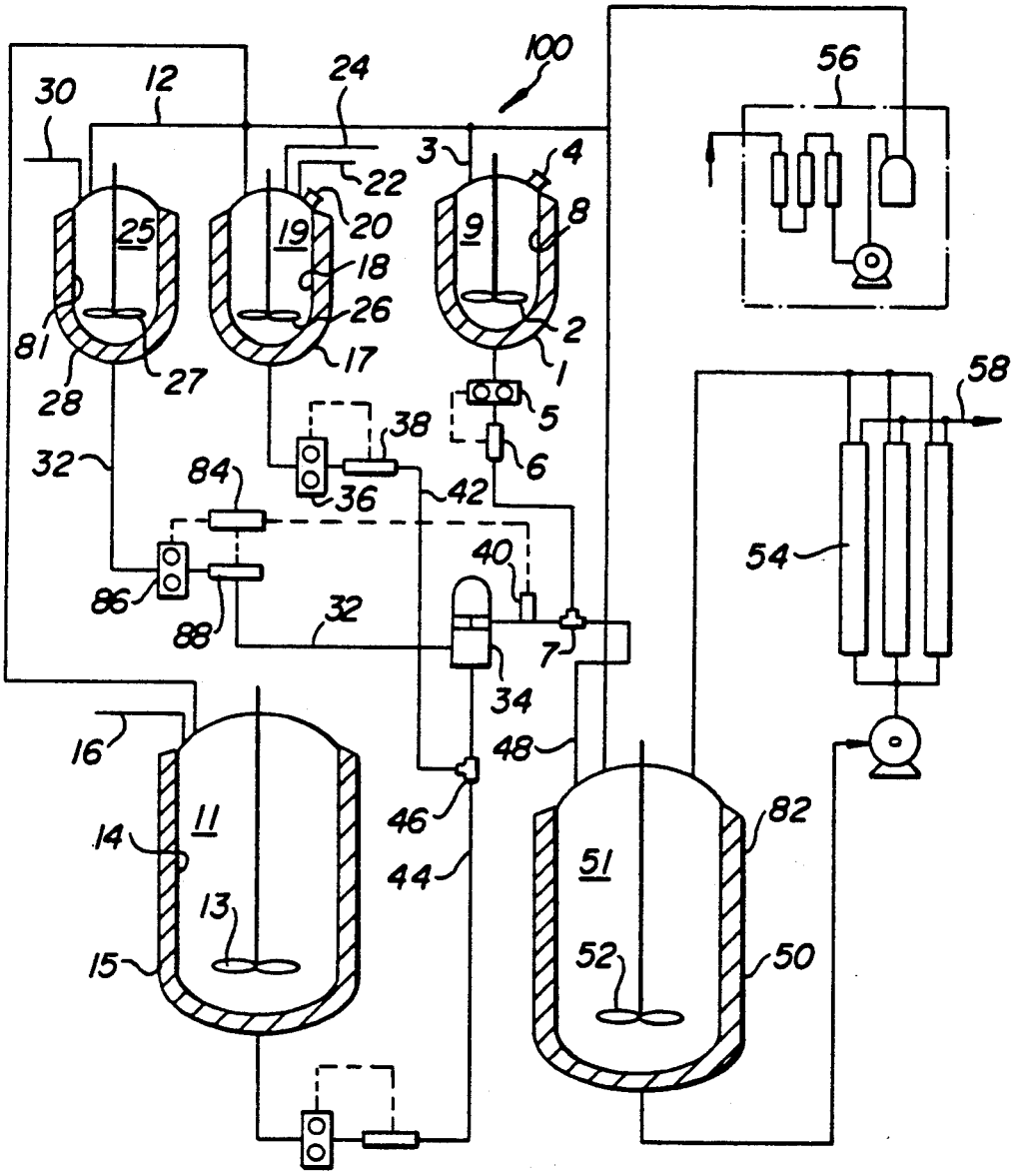

FIG. 2. Equipment for the precipitation of the dispersions of this invention in large scale.

Figure 3:
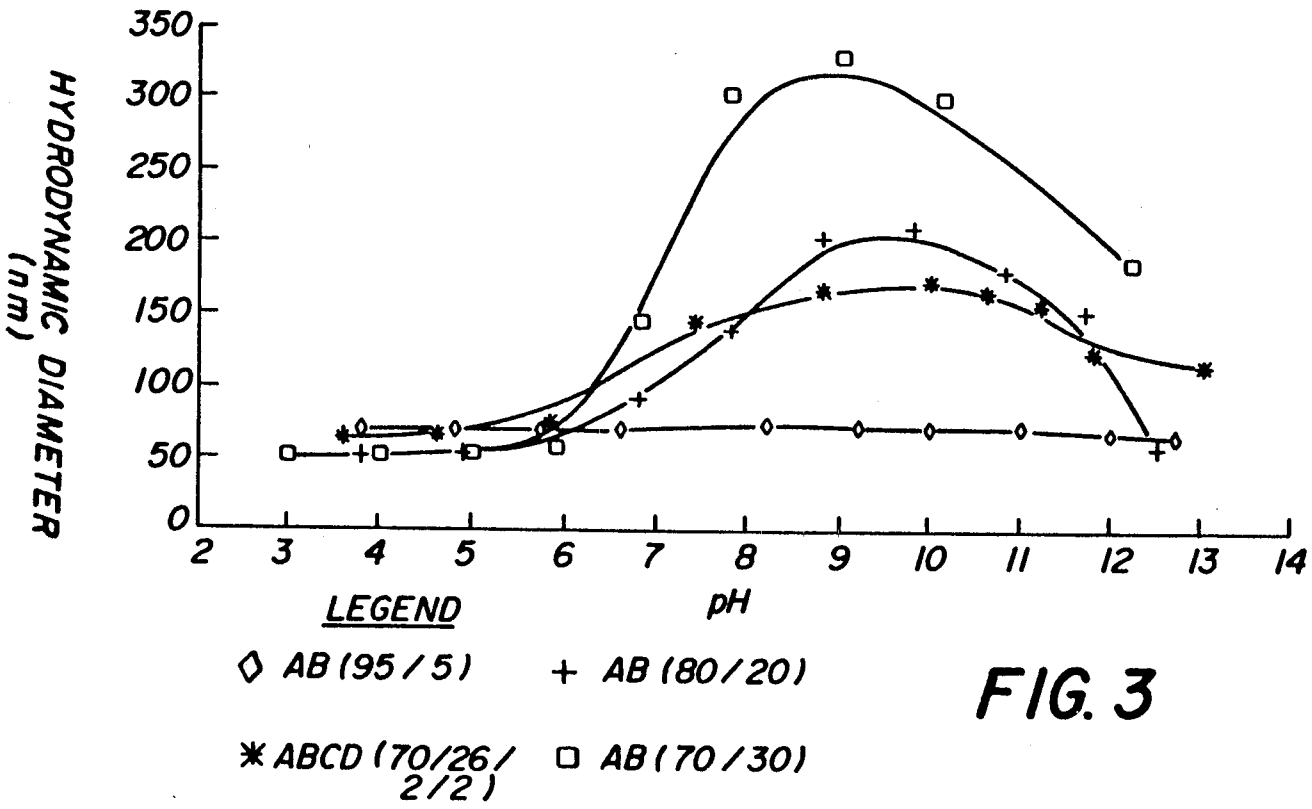

FIG. 3. Base induced swelling of the carboxylated latexes of poly(butylacrylate-co-methacrylic acid).

Figure 4:
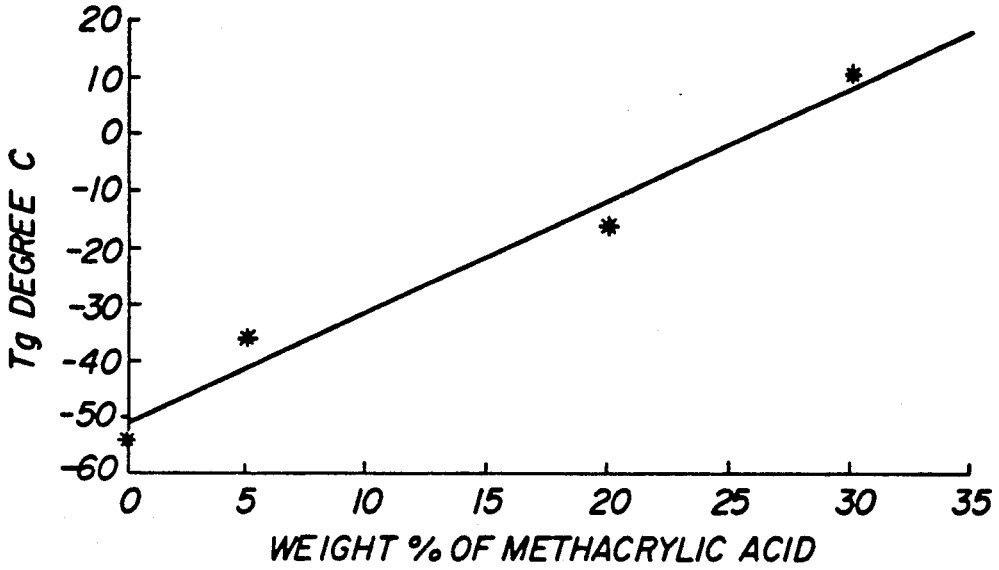

FIG. 4. Glass transition temperatures of poly(butylacrylate-co-methacrylic acid) as a function of the weight % of methacrylic acid.

Figure 5:
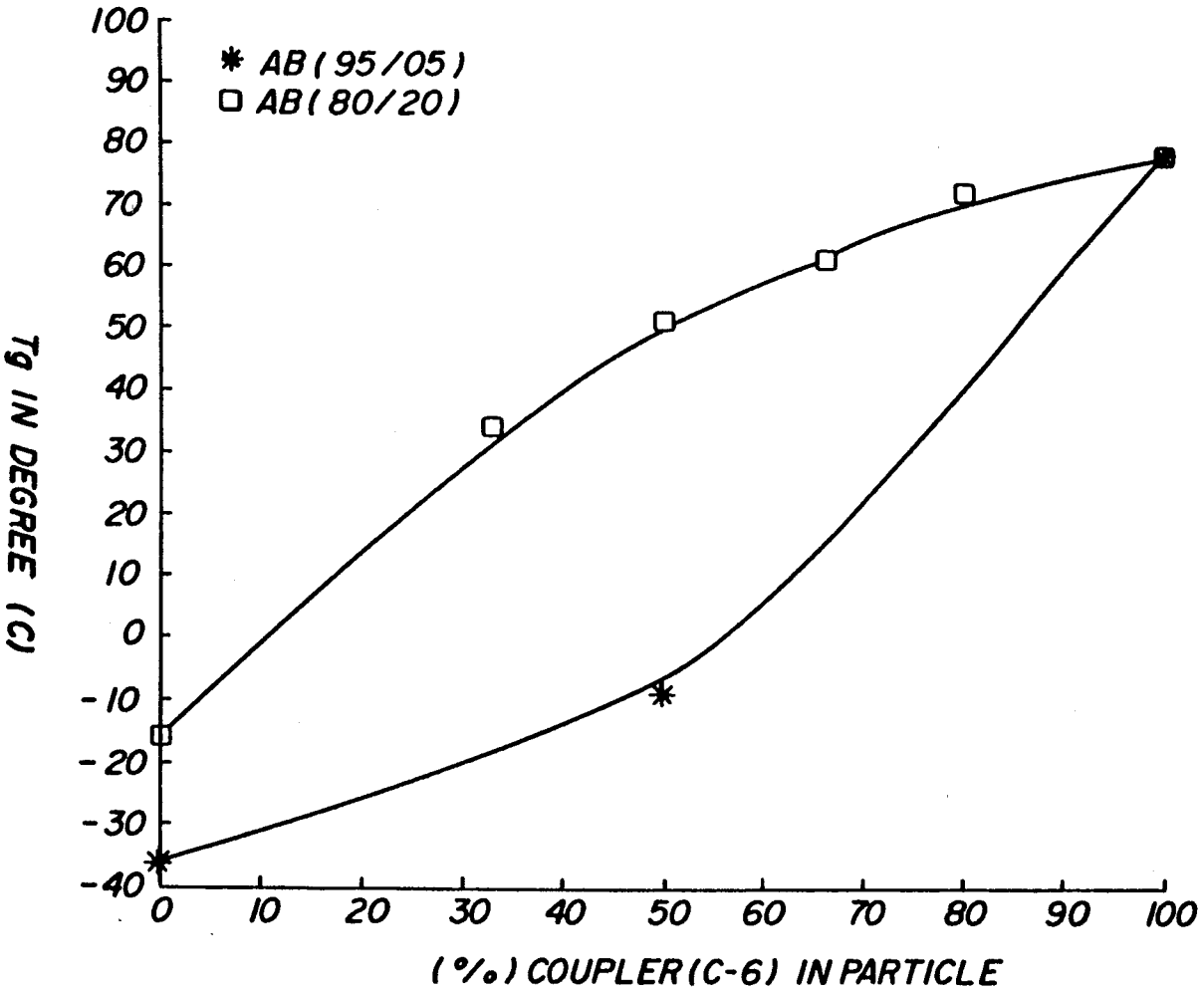

FIG. 5. Glass transition temperatures of the dried coupler (C-6) dispersions of this invention as a function of the amount of coupler incorporation in the dispersion particle as determined by differential thermal analysis.

Figure 6:
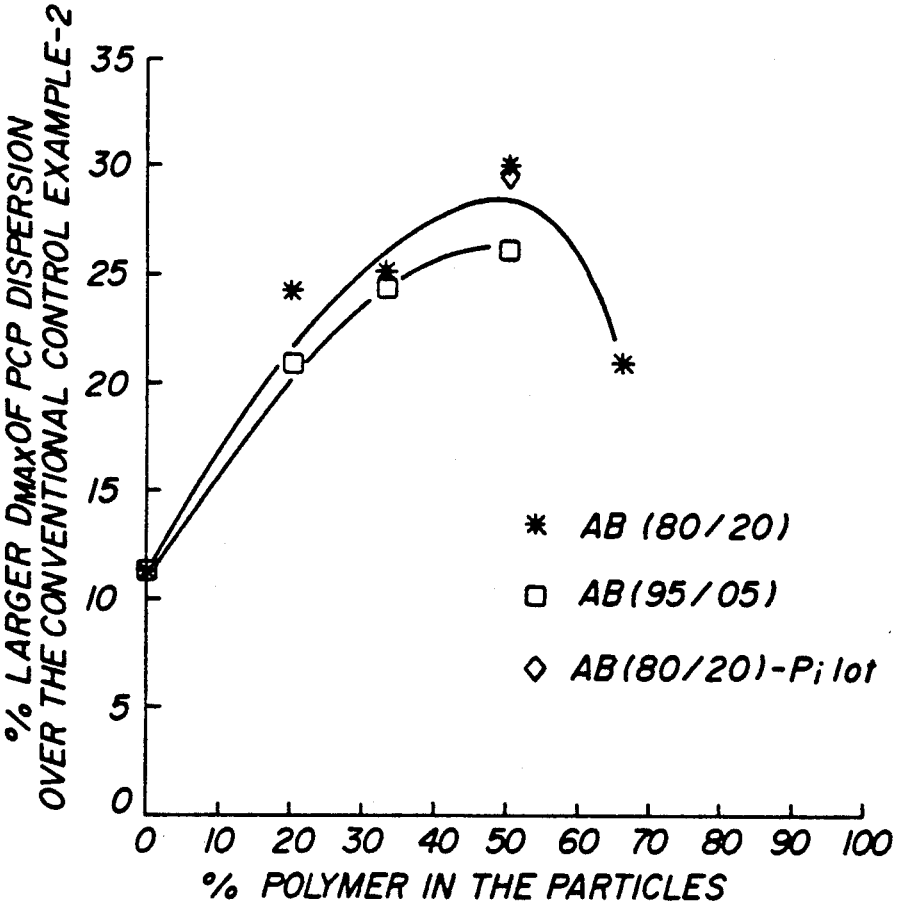

FIG. 6. Enhancement of the dye density yields of the inventive dispersions of coupler (C-6) (Table-IV) over the prior art dispersion of Example 2.

Figure 7:
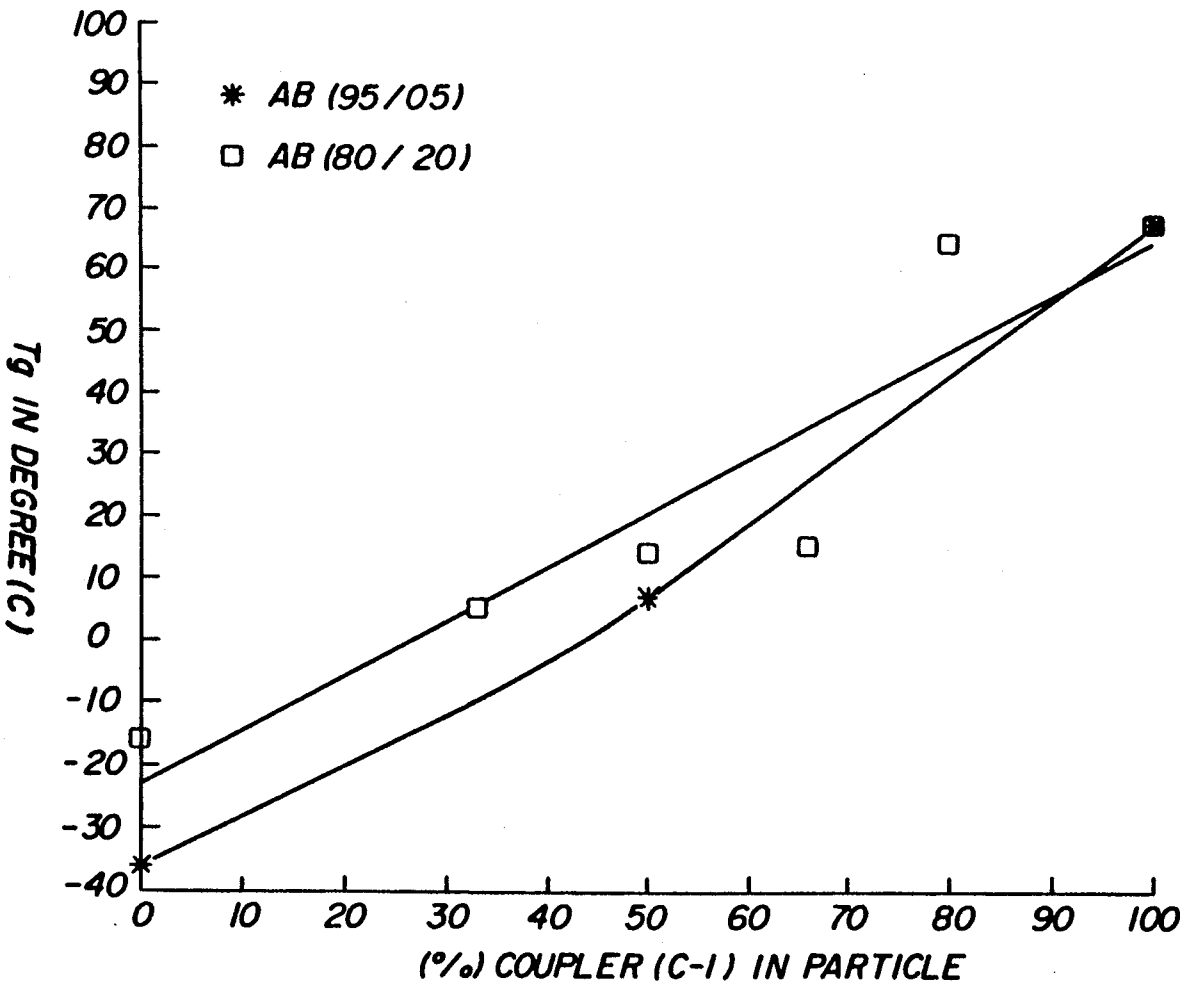

FIG. 7. Thermal properties of the inventive dispersions of coupler (C-1).

Figure 8:
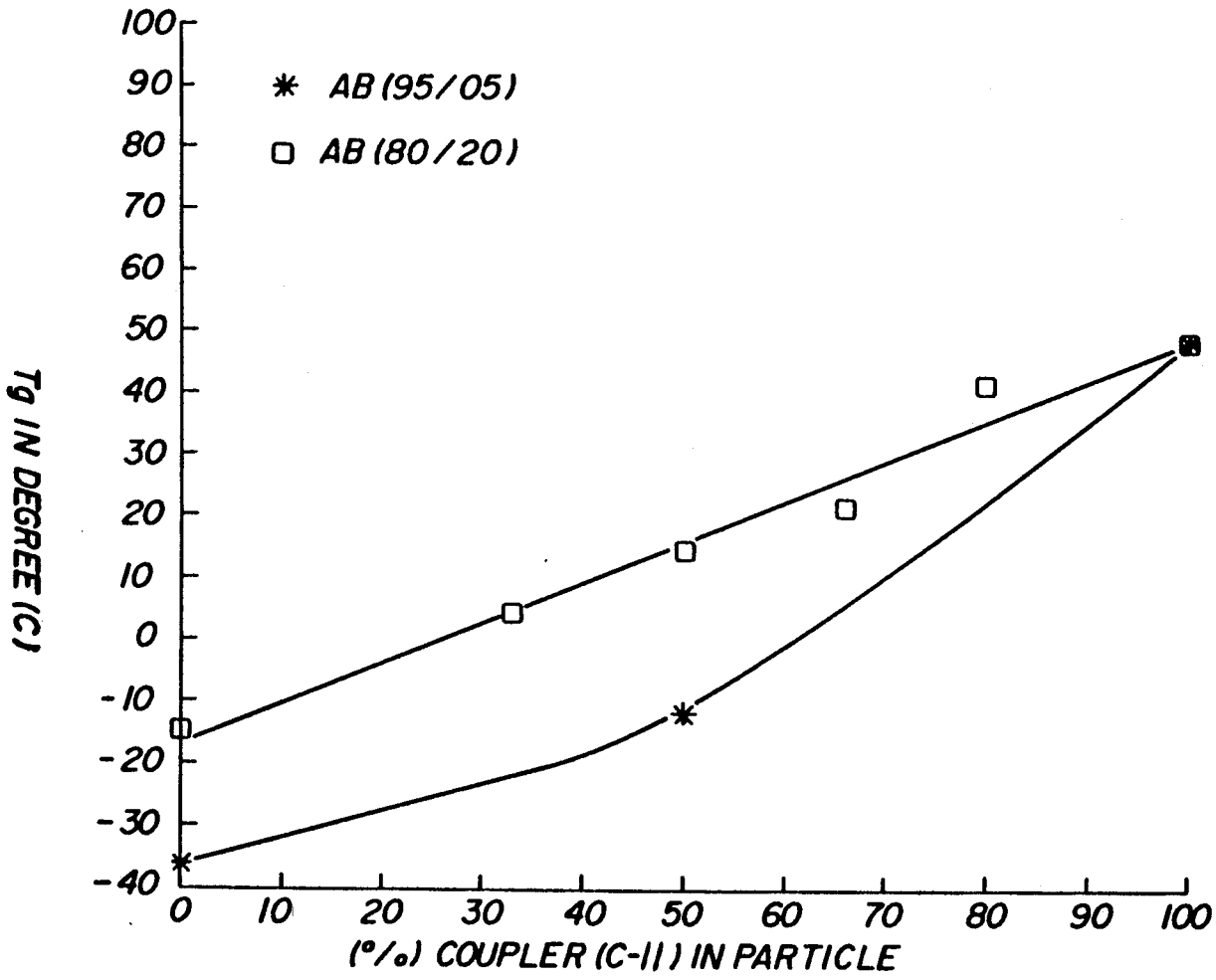

FIG. 8. Thermal properties of the inventive dispersions of coupler (C-6).

MODES OF CARRYING OUT THE INVENTION

This invention provides numerous advantages over prior art processes.

Inventive dispersions of many couplers produce images with much higher dye density compared to conventional milled coupler dispersions containing high boiling coupler solvents. Precipitated dispersions of the invention with a particle diameter larger than 100 nm produce no high viscosity problems when mixed with gelatin.

The invention dispersions are room temperature keepable for very long periods of time compared to conventional gel containing coupler dispersions that need to be refrigerated. The co-precipitation technique of the invention lends itself to loading ratios of coupler to polymer to any ratio desired. In the examples we have shown up to 4 parts coupler 1 part polymer. In contrast the prior art method of Chen (R-3) ratios of 1 part polymer and 3 part coupler is about the maximum loading ratio that can be achieved. Compared to the latex loading method of Chen (R-3), the PCP (polymer co-precipitated dispersions of this invention) dispersions require a fractional quantity of water-miscible solvent, as solubilization is assisted by ionization with base. This not only is a cost saving advantage compared to the method of Chen, but much less hazardous as no solvent stripping is involved. Another advantage is that images produced by the dye-forming coupler dispersions of this invention often have high light stability and better fade resistance. Another advantage is that the couplers can be precipitated in large scale (15 kg) at 10% coupler which is in the range of concentration needs for the formulation of standard photographic products. This is a manufacturing advantage.

It is an advantage that no high boiling coupler solvents are needed for the activation of the coupler as long as the invention coupler and latex particle has a glass transition temperature lower than about 50° C. This reduces tackiness and mushiness of the coated film and creates an environmentally safer product.

It is an advantage that the inventive dispersion particles are uniform and have a diameter around 100 nm, a contrast with the milled dispersions which have a broad size distribution and the larger particles may be as large as 1000 nm, which sometimes can contribute to the graininess of this image. The particle size of such narrow distribution particles are easy and swift to characterize by technique such as photon correlation spectroscopy, which lends to less expense in quality assurance metrology. Further, the inventive process is amenable to a continuous process control (less product variability) manufacturing procedure, which can produce large cost savings in high volume products such as color paper.

The invention is practiced in the small scale semicontinuous mode by bringing in a first flow of water, latex polymer, surfactant and base to fill the reaction vessel. Then a second flow of a solution of coupler, base and auxiliary solvent is added to the reaction vessel, which is being continuously stirred by a mixer. Precipitation of the coupler inside the polymer particle is achieved by a controlled third flow of propionic or acetic acid solution using a pump controlled by a processor, which senses the pH of the reactor and stops delivery of the acid at a pH of 6±0.2. The dispersion is then disfiltered to remove this auxiliary solvent.

In preferred methods, for large scale preparation, the first stream of coupler and base is dissolved in water and the second stream of the aqueous surfactant base and latex particles may be brought together immediately prior to a centrifugal mixer with addition of acid directly into the mixer. The streams will have a residence time of about 1 to about 30 seconds in the mixer. When leaving the mixer, they may be disfiltered on line to remove the auxiliary solvent and immediately be processed for utilization in photographic materials. When the process is stopped, the mixer may be shut off with minimum waste of material, as it is only necessary to discard the material in the mixer and pipelines immediately adjacent to it when the process is reactivated after a lengthy shutdown.

The process of the invention produces particles of coupler that are present in water without gelatin. The gelatin free suspensions of the invention are stable in storage and may be stored at room temperature rather than chilled as are gelatin suspensions.

FIG. 1 illustrates the semicontinuous equipment to prepare such dispersions as those of this invention for small laboratory size preparation. This equipment is used for the preparation of the invention dispersion in volumes up to 700 mL, in semicontinuous mode for a total coupler weight of 20 g. Container 104 is provided with an aqueous surfactant solution with the latex polymer and some alkali 124. Container 96 is provided with an acid solution 98. Container 100 combines a basic solution 102 of coupler in solvent. Container 104 provides high shear mixing and is the reaction chamber where dispersion formation takes place. The size of the acid kettle 96, the coupler kettle 100, and the reaction kettle are all of about 800 mL in capacity. In the system of FIG. 1, the reactor 104 is initially provided with an aqueous solution of the surfactant, the carboxylated latex, and some alkali to ionize the latexes. The coupler is dissolved in base and a water-miscible solvent generally at an elevated temperature in a separate vessel and then cooled down to room temperature and placed in kettle 100. The dispersion preparation process is started by starting the coupler pump 112, which pumps in basic coupler solution into the reaction chamber 104 under continuous agitation provided by the stirrer 116. The pH is monitored during any stage of the precipitation process using pH meter 120 which is connected to the ph-electrode system 122 and a thermostat probe 140 for temperature sensing. The pH is recorded in the strip chart recorder 130. After the coupler solution has been pumped into the reaction chamber 104, pump 112 is stopped and pump 118 is started to pump acid solution into the reaction chamber 104 via tube 121 for the neutralization and precipitation of the coupler, under vigorous stirring. The acid solution is pumped until the pH of the reaction chamber reaches a pH of 6.0±0.2, at which time this acid pump 118 is shut off. The constant temperature bath 136 is provided to keep the temperature of the three kettles identical. It is usually kept at about room temperature.

Dispersions prepared in this manner are worked by continuous dialysis against distilled water for 24 h to remove all the salts and solvent from the formed dispersion.

In a large scale (between 1000 and 3000 g of coupler) the apparatus 100 of FIG. 2 is utilized to perform the precipitation process for this invention. The apparatus is provided with high purity water delivery lines 12. Tank 14 contains a suspension 11 of base, surfactant, latex, and high purity water. Jacket 15 on tank 14 regulates the temperature of the tank. Surfactant enters the tank through line 16. Tank 18 contains a photographic component solution 19. Jacket 17 controls the temperature of materials in tank 18. The tank 18 contains a coupler entering through manhole 20, a base material such as aqueous sodium hydroxide solution entering through line 22, and solvent such as n-propanol entering through line 24. The solution is maintained under agitation by the mixer 26. Tank 81 contains acid solution 25 such as propionic acid entering through line 30. The tank 81 is provided with a heat jacket 28 to control the temperature, although with the acids normally used, it is not necessary. In operation, the acid is fed from tank 81 through line 32 to mixer 34 via the metering pump 86 and flow meter 88. A pH sensor 40 senses the acidity of the dispersion as it leaves mixer 34 and allows the operator to adjust the acid pump 86 to maintain the proper pH in the dispersion exiting the mixer 34. The photographic component 19 passes through line 42, metering pump 36, flow meter 38, and joins the basic surfactant-/polymer suspension in line 44 at the "T"-fitting 46. The coupler precipitates into the polymer particles in mixer 34 and exit through pipe 48 into the ultrafiltration tank 82. In tank 82 the dispersion 51 is held while it is washed by ultrafiltration membrane 54 to remove the solvent and salt from solution and adjust the material to the proper water content for makeup as a photographic component. The source of high purity water is purifier 56. Agitator 13 agitates the surfactant solution in tank 14. Agitator 27 agitates the acid solution in tank 81. The impurities are removed during the ultrafiltration process through permeate (filtrate) stream 58. With some precipitations, materials that undergo crystallization after formation of the PCP dispersion require additional colloidal stabilizer after the dispersion particles are formed. In such special cases solution of the polymer in high purity water is made in tank 8, which has a temperature control jacket 1 and a mixing stirrer 2. High purity water is fed in through the line 3, and the polymer is fed in through the manhole 4. The polymer solution passes through the flow meter 6 and pump 5 and is mixed in at "T", 7, at a metered rate with the formed final dispersion. The colloidal stabilizing polymers that are useful for this purpose are polyvinyl pyrrolidone, and other water soluble polymers.

The auxiliary solvent for dissolving the photographic component may be any suitable solvent that may be utilized in the system in which precipitation takes place by solvent shift and/or acid shift. Typical of such materials are the solvents acetone, methyl alcohol, ethyl alcohol, isopropyl alcohol, tetrahydrofuran, dimethylformamide, dioxane, N-methyl-2-pyrrolidone, acetonitrile, ethylene glycol, ethylene glycol monobutyl ether, diacetone alcohol, etc. A preferred solvent is n-propanol, because n-propanol is a good solvent for most couplers and allows the formation of highly concentrated, stable, super saturated solutions of the ionized couplers at room temperature.

The acid and base may be any materials that will cause a pH shift and not significantly decompose the photographic components. The acid and base utilized in the invention are typically sodium hydroxide as the base and propionic acid or acetic acid as the acid, as these materials do not significantly degrade the photographic components and are low in cost.

The polymer particles that are useful for the coprecipitation of couplers are polymer particles that have glass transition temperature less than 50° C. Such polymer particles could be ethylynically linked vinyl addition polymer or condensation polymer particles such as polyesters or polyurethanes.

Such polymer particles should preferably contain at least 0.1% negatively charged monomers either fully ionized such as a monomer containing a $-SO_3$ group or base ionizable monomer groups such as acrylic or methacrylic acid. The preferred composition for such polymers are poly(n-butylacrylate-co-methacrylic acid) with at least 10% of methacrylic acid by weight. The preferred particle diameter of the latex particles are less than 200 nm. However, particles of diameters up to 800 nm can be useful for this invention.

The surfactants of the invention may be any surfactant that will aid in formation of stable dispersions of particles and preferably is not hydrolyzed by base. Typical of such surfactants are those that have a hydrophobic portion to anchor the surfactant to the particle and a hydrophilic part that acts to keep the particles separated ether by steric repulsion (see, for example, P. Bagchi, J. Colloid and Interface Science, Vol. 47, page 86, and 110, 1974, Vol. 41, page 380, 1972, and Vol. 50, page 115, 1975) or by charge repulsion. Many classes of surfactants can be utilized to perform this invention They can, in general, be classified in the following classes:

Class I: Surfactants with single, double or triple $C_5$ to $C_{25}$ hydrocarbon chain terminated with one or more charged head groups. Additional polymeric or oligomeric steric stabilizers could be used with such surfactants.

Examples of this class of surfactants are as follows:

I-1 $CH_3-(CH_2)_{11}-SO_4^-Na^+$ (Sodium Dodecyl Sulfate)

I-2 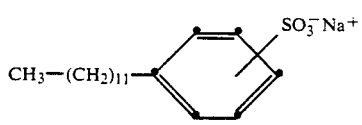 (Sodium Dodecyl Benzene Sulfonate)

I-3 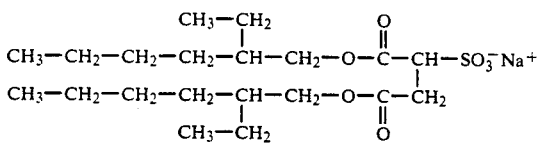 (Aerosol OT Cyanamid)

I-4 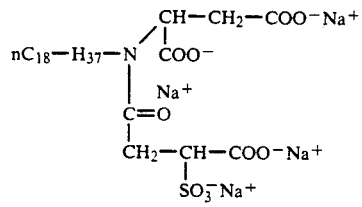 (Aerosol 22 Cyanamid)

I-5 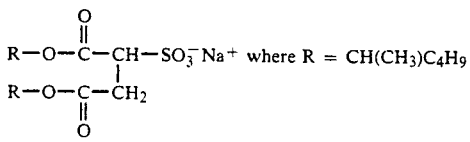 (Aerosol MA Cyanamid)

-continued

| | | |
|---|---|---|
| I-6 | " | R = $-CH_2-CH_2-$ 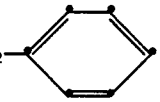 |
| I-7 | " | 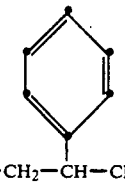 R = $-CH_2-CH-CH_3$ |
| I-8 | " | R = $-CH_2-CH(CH_2CH_3)C_3H_7$ |
| I-9 | 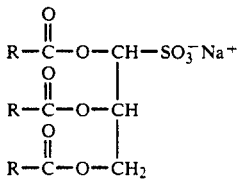 | R = $-(CH_2)_nCH_3$ (n = 2, 3 & 5) |
| I-10 | " | R = $-(CH_2)_n-$ 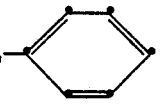 (n = 2 to 5) |
| I-11 | 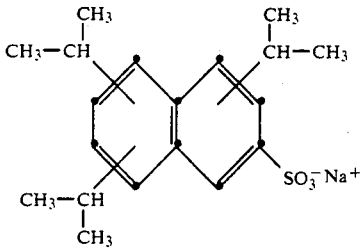 | (Alkanol-XC Dupont) |

Use of additional polymeric or oligomeric steric stabilizers, in addition to such surfactants, can provide additional colloidal stability to such dispersions and can be added if necessary. Polymeric materials for such use are water soluble, homo-, or co-polymers such as polyvinyl pyrrolidone, dextran, and derivatized dextrans. Other types of oligomeric co-stabilizers that can be used are block oligomeric compounds comprising hydrophobic polyoxypropylene blocks A and hydrophilic polyoxyethylene blocks B joined in the manner of A—B—A, B—A—B, A—B, $(A—B)_n \equiv G \equiv (B—A)$, or $(B—A)_n \equiv G \equiv (A—B)$, where G is a connective organic moiety and n is between 1 and 3. Examples of such surfactants are shown in Table A.

TABLE A

Examples of Block Oligomeric Costabilizers For Use Along With Surfactants of Class I

| ID | Name (Manufacturer) | Best Known Structure | Molecular Weight Range |
|---|---|---|---|
| P-1 | Pluronic TM Polyols (BASF) | $HO-(CH_2CH_2-O)_a-(CH(CH_3)-CH_2-O)_b-H-(OCH_2-CH_2)_c$ | 1,100 to 14,000 |
| P-2 | Pluronic TM-R Polyols (BASF) | $HO-(CH(CH_3)-CH_2-O)_a-(CH_2-CH_2-O)_b-H-(O-CH_2-CH(CH_3))_c$ | 1,900 to 9,000 |
| P-3 | Plurodot TM Polyols (BASF) | Liquid Polyethers Based on Alkoxylated Triols | 3,200 to 7,500 |

TABLE A-continued

Examples of Block Oligomeric Costabilizers For Use Along With Surfactants of Class I

| ID | Name (Manufacturer) | Best Known Structure | Molecular Weight Range |
|---|---|---|---|
| P-4 | Tetronic TM Polyols (BASF) | $HO-(CH_2CH_2-O)_y-(CH(CH_3)-CH_2-O)_x$ <br> $HO-(CH_2CH_2-O)_y-(CH(CH_3)-CH_2-O)_x$ <br> $N-CH_2-CH_2-N$ <br> $HO-(CH_2CH_2-O)_y-(CH(CH_3)-CH_2-O)_x$ <br> $HO-(CH_2CH_2-O)_y-(CH(CH_3)-CH_2-O)_x$ | 3,200 to 27,000 |

Class II—Surfactants comprising between 6 to 22 carbon atom hydrophobic tail with one or more attached hydrophilic chains comprising at least 4 oxyethylene and/or glycidyl ether groups that may or may not be terminated with a negative charge such as a sulfate group.

Examples of such surfactants are as follows:

Class III—Sugar surfactants, comprising between one and three 6 to 22 carbon atom hydrophobic tails with one or more attached hydrophilic mono, di, tri or oligosaccharidic chains that may or may not be terminated by a negatively charged group such as a sulfate group.

Examples of such surfactants are as follows:

| | | |
|---|---|---|
| II-1 | 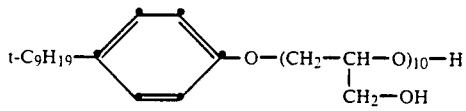 | Olin 10G (Dixie) |
| II-2 | $n\text{-}C_{12}H_{25}-O-(CH_2-CH_2-O)_{12}-SO_3^-Na^+$ | Polystep B-23 (Stepan) |
| II-3 | 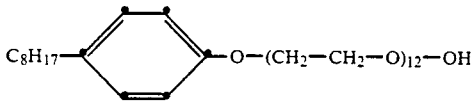 | Triton TX-102 (Rohm & Haas) |
| II-4 | $n\text{-}C_{12}H_{25}-O-(CH_2-CH_2-O)_{23}-OH$ | Tricol LAL-23 (Emery) |
| II-5 | $C_{12}H_{25}-O-(CH_2-CH_2-O)_{15}-CH_2-CH_2-SO_3^-Na^3$ | Avanel S-150 (PPG) |
| II-6 | $n\text{-}C_{12}H_{25}-O-(CH_2-CH_2-O)_n-C(=O)-CH(CH_2-COO^-Na^+)-SO_3^-Na^+$ <br> n = 3-5 | Aerosol A102 (Cyanamid) |
| II-7 | 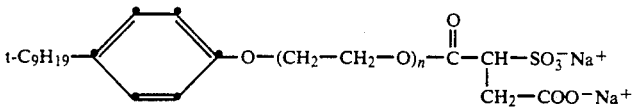 <br> n = 5-10 | (Aerosol A103 (Cyanamid) |

III-1

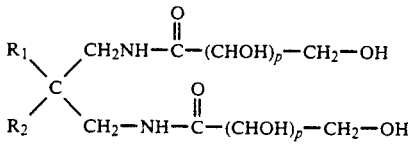

-continued
where, $R_1$ = n-$CH_3$—$(CH_2)_x$— (where x = 3 to 10)
$R_2$ = 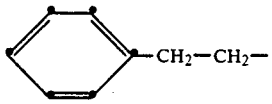
P = 3 to 10
III-2
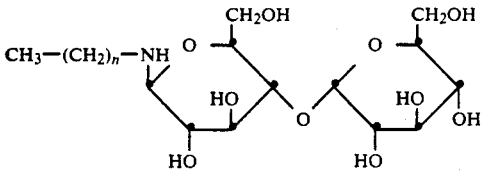
where, n = 3 to 15
III-3
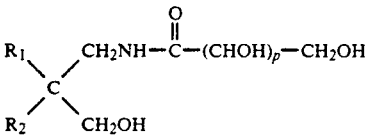
where, $R_1$ = n-$CH_3$—$(CH_2)_x$— (where x = 3 to 10)
$R_2$ = 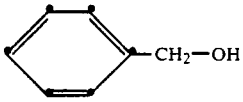
P = 3 to 15
III-4
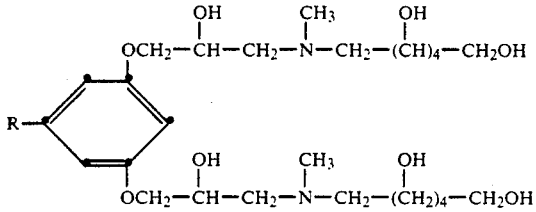
where, R = n-$CH_3$—$(CH_2)_x$— (where, x = 1 to 5)
III-5
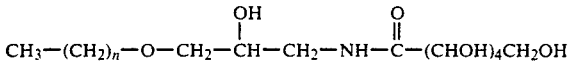
where, n = 3 to 15
III-6
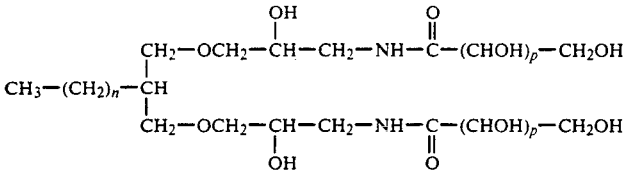
where, n = 2 to 12
p = 3 to 10
III-7
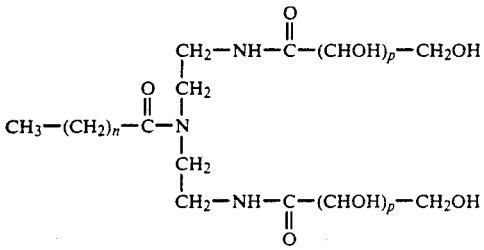
where, n = 2 to 18
p = 3 to 10

-continued

III-8

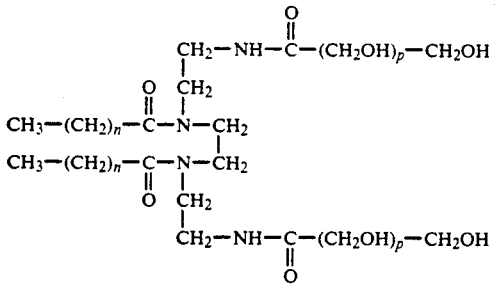

where, n = 2 to 18
p = 3 to 10

III-9

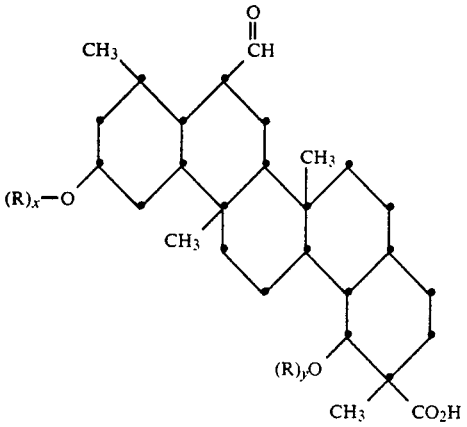

$R_x$, $R_y$ are polyglucosides

III-10

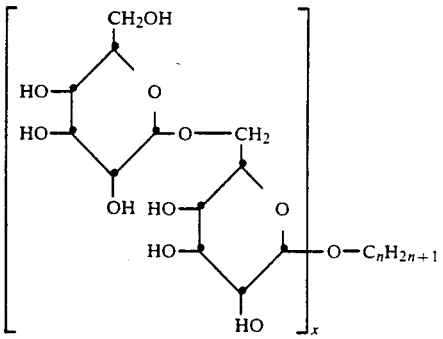

where 8 ≦ n ≦ 14 and 1.4 ≦ x ≦ 1.8.

The invention may be practiced with any hydrophobic photographic component that can be solubilized by base and solvent. Typical of such materials are colored dye-forming couplers, development inhibitor release couplers, development inhibitors, filter dyes, UV-absorbing dyes, development boosters, development moderators, and dyes. Suitable for the process of the invention are the following coupler compounds which have been utilized to form precipitated dispersions:

C-1
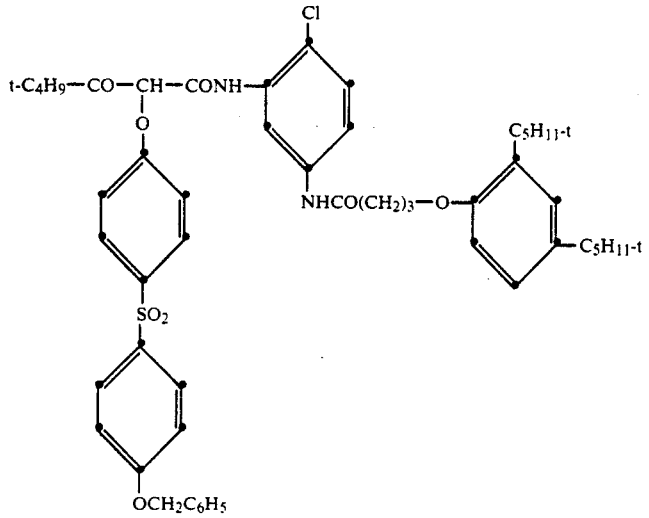
C-2
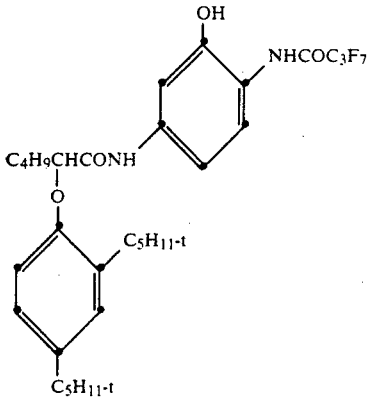
C-3
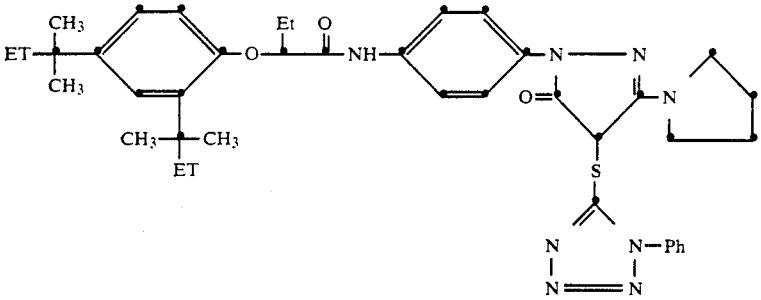
C-4
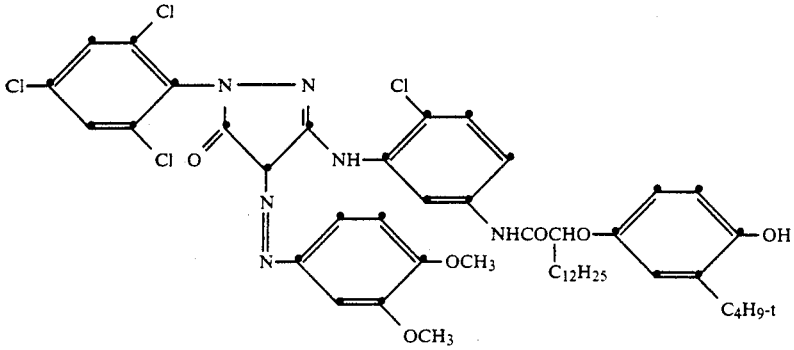

-continued
C-5
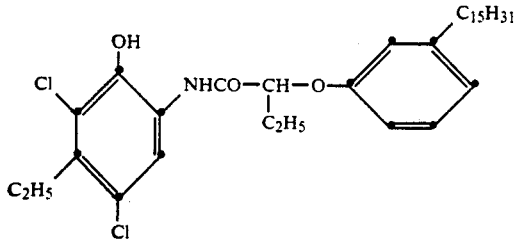
C-6
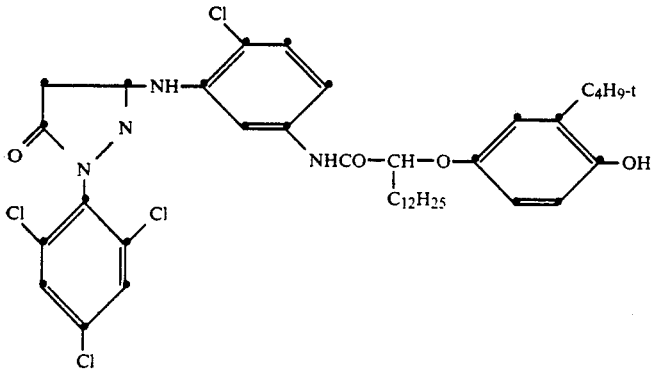
C-7
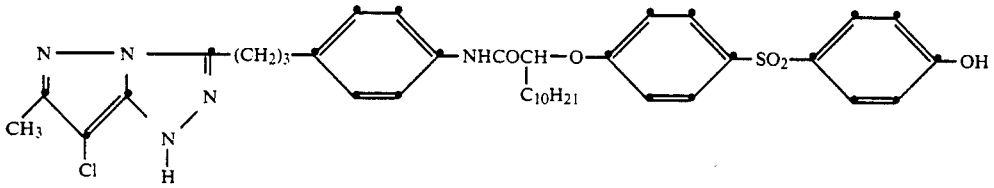
C-8
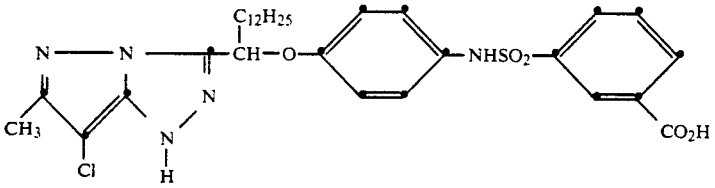
C-9
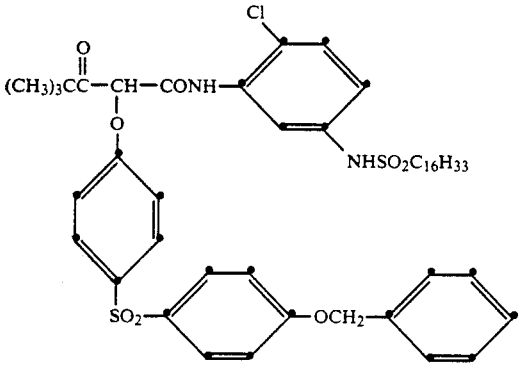

-continued
C-10
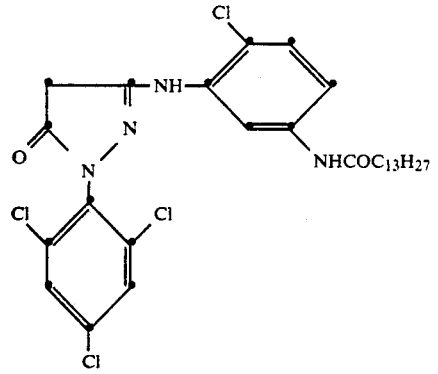
C-11
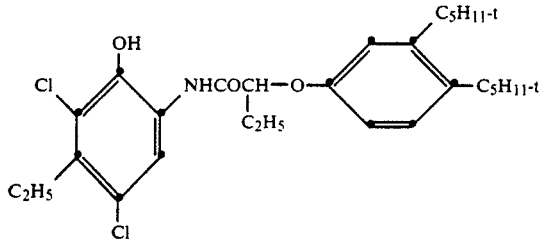
C-12
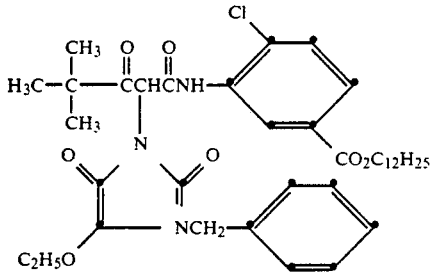
C-13
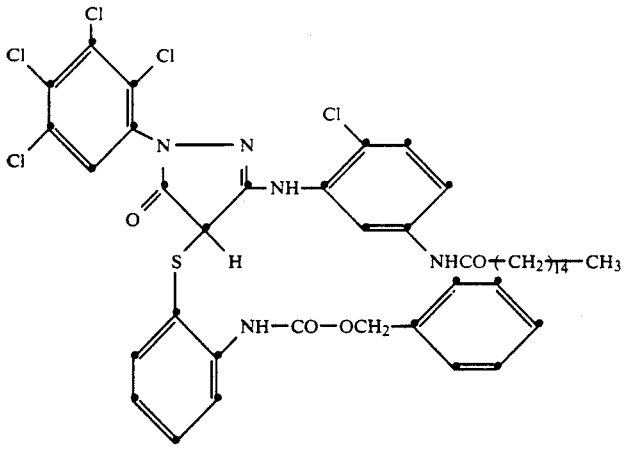
C-14
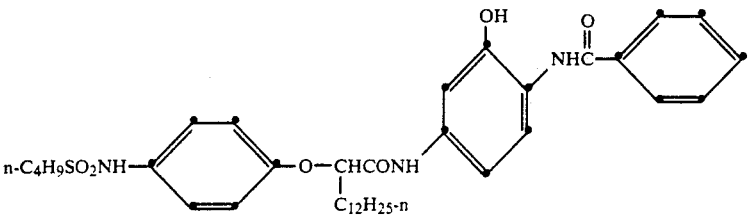

-continued

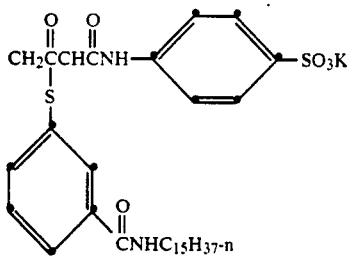

C-15

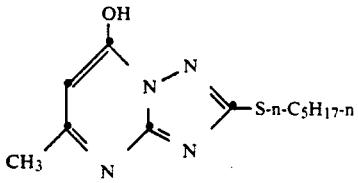

C-16

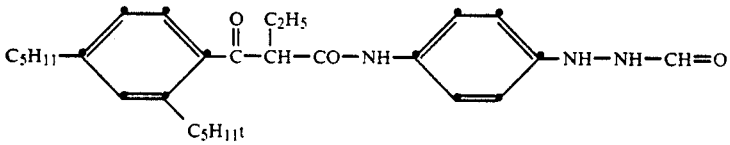

C-17

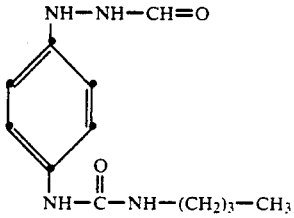

C-18

The process of this invention leads to gelatin free, fine particle colloidal dispersions of photographic materials, such as compounds 1 through 17, that are stable from precipitation for at least several months at room temperature. This is a cost saving feature as conventional milled dispersions need to be stored under refrigerated conditions.

The mixing chamber, where neutralization takes place, may be of suitable size that has a short residence time and provides high fluid shear without excessive mechanical shear that would cause excessive heating of the particles. In a high fluid shear mixer, the mixing takes place in the turbulence created by the velocity of fluid streams impinging on each other. Typical of mixers suitable for the invention are centrifugal mixers, such as the "Turbon" centrifugal mixer available from Scott Turbon, Inc. of Van Nuys, Calif. It is preferred that the centrifugal mixer be such that in the flow rate for a given process the residence time in the mixer will be of the order of 1-30 seconds. Preferred residence time is 10 seconds or less to prevent particle growth and size variation. Mixing residence time should be greater than 1 second for adequate mixing.

DESCRIPTION OF MEASUREMENTS

All particle sizes of the precipitated dispersions were measured by photon correlation spectroscopy (PCS) as described in (R-18). Unless otherwise mentioned, all photographic development were carried out by the standard RA-4 color development process described in (R-19).

EXAMPLES

The following examples are intended to be illustrative and not exhaustive of the invention. Part and percentages are by weight unless otherwise specified.

EXAMPLES 1-4

Conventional Dispersions

Conventional dispersion, indicated in Table-I, were prepared by standard milling procedures as described in (R-20) for central coatings.

TABLE I

Compositions of Conventional Dispersions

| | | Dispersion Formulation | | | | | | | | |
|---|---|---|---|---|---|---|---|---|---|---|
| Example | Compound | Compound Wt. % | Coupler Solvent | Wt. % of Coupler Solvent | Surfactant | Wt. % of Surfactant | Stabilizer Compound | Wt. % of Stab. Compound | Dry Gel Wt. % | Water Wt. % |
| 1 | (C-1) | 12.9 | (S-1)<br>(S-2) | 3.2<br>3.2 | (I-11) | 0.9 | None | 0.0 | 8.8 | 71.0 |
| 2 | (C-6) | 8.7 | (S-1) | 8.7 | (I-11) | 1.0 | (ST-1)<br>(ST-2) | 3.7<br>0.9 | 8.7 | 76.3 |
| 3 | (UV-2) | 11.8 | None | 0.0 | (I-11) | 0.5 | None | 0.0 | 7.8 | 77.4 |

TABLE I-continued

| | | Compositions of Conventional Dispersions | | | | | | | | |
|---|---|---|---|---|---|---|---|---|---|---|
| | | Dispersion Formulation | | | | | | | | |
| Example | Compound | Compound Wt. % | Coupler Solvent | Wt. % of Coupler Solvent | Surfactant | Wt. % of Surfactant | Stabilizer Compound | Wt. % of Stab. Compound | Dry Gel Wt. % | Water Wt. % |
| | (UV-1) | 2.1 | | | | | | | | |
| 4 | | | (S-1) | 4.0 | (I-11) | 0.9 | (ST-1) | 8.0 | 5.0 | 74.0 |
| | | | (S-3) | 6.2 | | | (ST-2) | 1.9 | | |

It is to be noted that the dispersion of Example-3 does not contain any coupler solvent. The components (UV-1) and (UV-2) at elevated temperatures form an utectic mixture that is liquid that can be dispersed in aqueous gelatin solution like other conventional dispersions. Dispersion of Example-4 is a coupler free magenta stabilizer dispersion for coating with the magenta PCP dispersions.

The coupler solvents used to prepare these conventional dispersions are as follows:

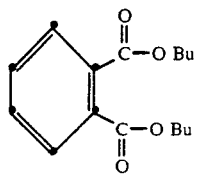

(S-1)

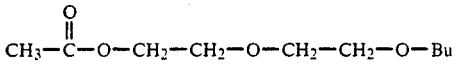

(S-2)

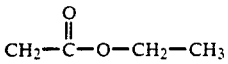

(S-3)

The stabilizer compounds used in the magenta dye-forming coupler dispersion are as follows:

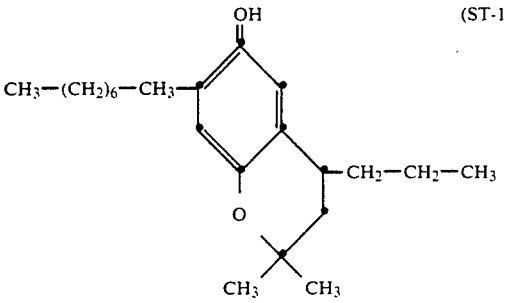

(ST-1)

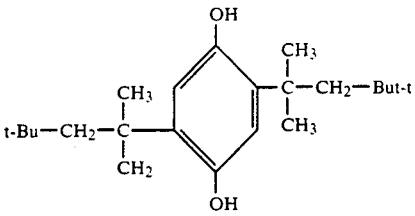

(ST-2)

The ultraviolet radiation absorbing compounds utilized are as follows:

Tinuvin 326

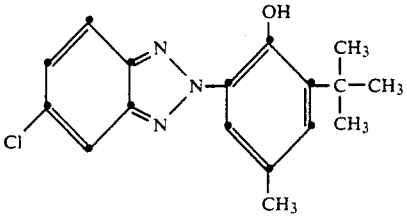

(UV-1)

-continued

Tinuvin 328

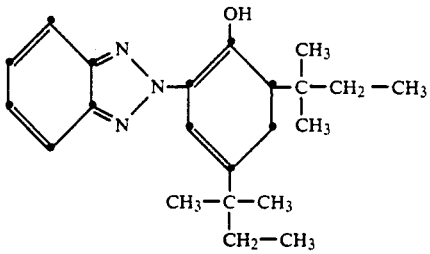

(UV-2)

In preparing the dispersions of Examples 1–4, the compounds were dissolved in the coupler at elevated temperature and then added to the gelatin solution containing the surfactant. The mixtures were homogenized in a colloid mill in 3 passes. The average particle diameter of these dispersion particles as measured by sedimentation field flow fractionation were around 200 nm.

EXAMPLES 5 and 6

Coating Formats for Photographic Evaluations (Conventional Prior Art Controls)

EXAMPLE 5

The coating format for testing magenta coupler (C-6) dispersion was as follows from the base up.

Base: Titanox dispersed polyethylene coated paper stock

Green Sensitized Layer: Green sensitized silver chloride cubic emulsions with up to about 1% surface bromide having an average cubic edge-length of about 0.3 microns in dispersion of Example 2 at 26.5 mg/ft$^2$. Magenta dye-forming coupler (C-6) at 41.5 mg/ft$^2$ stabilizer (ST-1) at 18.2 mg/ft$^2$. Scavenger (ST-2) at 3.4 mg/ft$^2$, gelatin at 115 mg/ft$^2$. This layer also contained appropriate amounts of coupler solvents associated with the dispersions as indicated in Table I. The inventive dispersions that follow do not contain any coupler solvent.

UV-Absorbing Layer: UV-Absorbing compound (UV-2) and (UV-1) in dispersion as in Example-3 at 80 mg/ft$^2$ and gelatin at 121 mg/ft$^2$.

Over Coat: 125 mg/ft$^2$ of gelatin and hardener Bis(-vinylsulfonylmethylether) (BVSME) at the level of 2% based upon the total gelatin in the packet.

In all cases the spreading agent (II-1) was used at a level of 0.3% of the melt volumes of each layer.

The coatings were exposed in white light through a gray wedge chart and then processed by the prior art (R-19) KODAK RA-4 process (KODAK is a trademark of the Eastman Kodak Co.) The resultant images were then read by a color densitometer. To determine dye-stability some of the images were exposed to 50 K lux Xenon light exposure, where the color temperature was balanced to about 4000° Kelvin for 2 and 4 weeks and the dye densities were read again to determine the changes due to the light exposure. This light exposure was carried out under ambient humidity conditions.

EXAMPLE 6

The coating format for testing yellow coupler (C-1) dispersions were as follows from base up:

Base: Titanox dispersed polyethylene coated paper stock

Blue Sensitized Layer: Blue sensitized silver chloride cubic emulsion with up to about 1% surface bromide having an average cubic edge length of about 0.6 microns at 30 mg/ft$^2$. Yellow dye-forming coupler (C-1) in dispersion of Example-1 at 100 mg/ft$^2$ and gelatin at 115 mg/ft$^2$. The layer also contained appropriate amounts of coupler solvents associated with the dispersions, as will be seen later. The inventive PCP dispersions contain any coupler solvent.

UV-Absorbing Layer: UV-Absorbing compound (UV-2) and (UV-1) in dispersion of Example-3 at 80 mg/ft$^2$ and gelatin at 121 mg/ft$^2$.

Over Coat: 125 mg/ft$^2$ of gelatin and hardener Bis(-vinylsulfonylmethylether) (BVSME) at the level of 2% based upon the total gelatin in the packet.

In all cases the spreading agent (II-1) was used at a level of 0.3% of the mill volumes of each layer.

The coatings were exposed, processed, and photographically tested in the same manner as described in Example-3.

EXAMPLES 7-10

Preparation of Polymers

These examples describe the preparation of the polymers used for making the PCP dispersions. Four different polymer compositions were used in this invention. Table II describes components used in the polymerization of the examples of the polymers in 400 g monomer scale.

TABLE II

| | Components of Polymers of Examples 7-10 Monomers (quantity, g) | | | | |
|---|---|---|---|---|---|
| Example | Monomer A | Monomer B | Monomer C | Monomer D | Nitrogen Purged Water (g) |
| 7 | 380 | 20 | — | — | 4000 |
| 8 | 320 | 80 | — | — | 4000 |
| 9 | 280 | 120 | — | — | 4000 |
| 10 | 280 | 104 | 8 | 8 | 4000 |

A = Butyl Acrylate
B = Methacrylic Acid
C = Ethylene Dimethacrylate
D = 2-Sulfo-1,1-dimethyl acrylamide, sodium salt 4000 g of distilled water was placed in a 5 L 3 neck volumetric flask in a constant temperature bath at 60° C. and purged with nitrogen. One neck was fitted with a paddle stirrer which rotated at about 200 RPM. The second neck was fitted with a condenser and the third neck provided with a nitrogen blanket. In each case, first 8 g of sodium dodecyl sulfate was added to the flask. After dissolution, the monomer was added and allowed to come to 60° C. Then 8 g of $K_2S_2O_8$ and 4 g of $K_2S_2O_5$ were added and allowed to react for 18 hours. Yield of polymer was about 98% and had a solids of about 9.5%. Sometimes the latex was concentrated by applying vacuum to the flask and allowed to stir at 60° C. for about 24 hours. In this manner the latex could be concentrated to 15 to 20% solids.

FIG. 3 shows a plot of the pH dependences of the hydrodynamic sizes of the four above latexes as measured by photon correlation spectroscopy (PCS). The start of the swelling of these latexes indicate the ionization of the —COOH groups in the latexes. It shows that the swelling of the AB latexes is proportional to the B content. In other words, in the AB series the swelling increases in the following direction:

AB (95/5)<AB (80/20)<AB (70/30)(wt % of monomers)

It is to be noted that swelling starts about pH 6.0, and they are all well swollen under development pH of 10 and above. AB (95/5) shows very little swell indeed. This is indicative of the fact that 5% B is just about the amount that covers the particle surface for latexes of these sizes (around 60 nm in diameter). It is also to be noted that ABCD (70/26/2/2) which is cross-linked with D has much less swell compared to AB (70/30) which has the same amount of methacrylic acid.

The glass transition temperature of these polymers were determined by differential thermal analysis of films formed by drying the latex polymers and are listed in Table III.

TABLE III

| Glass Transition Temperatures, Tg, of (Poly(Butylacrylate-co-methacrylic Acid) Copolymers | | |
|---|---|---|
| Polymer | Tg °C. | Comment |
| A (100) | −54 | From (R-21) |
| AB (95/5) | −36 | Polymer of Example-7 |
| AB (80/20) | −16 | Polymer of Example-8 |
| AB (70/30) | +11 | Polymer of Example-8 |

FIG. 4 shows that the Tg of such polymers increase linearly as expected with the weight fraction of methacrylic acid, which is the higher Tg component. It also shows, therefore, that the glass transition temperatures of such polymers can be changed by incorporating various amounts of butyl acrylate (B).

EXAMPLE 11

Preparation of Poly(Butyl Acrylate-co-Methacrylic Acid) [Weight Ratio 80/20]

A 22 L three-neck round bottom flask fitted with a condenser and an air stirrer was charged with 16L of nitrogen purged distilled water and heated to 60° C. in a constant temperature bath. The following were added in the flask:

| | |
|---|---|
| Butyl acrylate | 1280 g |
| Methacrylic acid | 80 g |
| Sodium dodecyl sulfate | 32 g |
| $K_2S_2O_8$ | 32 g |
| $K_2S_2O_5$ | 16 g |

The reaction was carried out under nitrogen for 20 hours at 60° C. Particle diameter of the mixed batch as determined by PCS was around 58 nm. Thus was produced a latex at 9.4% solids.

EXAMPLE 12

Preparation of Poly(Butyl Acrylate-co-Methacrylic Acid) [Weight Ratio 95/5]

A 22 L three-neck round bottom flask fitted with a condenser and an air stirrer was charged with 16L of nitrogen purged distilled water and heated to 60° C. in a constant temperature bath. The following were added in the flask:

| | |
|---|---|
| Butyl acrylate | 1520 g |
| Methacrylic acid | 80 g |
| Sodium dodecyl sulfate | 32 g |
| $K_2S_2O_8$ | 32 g |
| $K_2S_2O_5$ | 16 g |

The reaction was carried out under nitrogen for 20 hours at 60° C. Vacuum was applied to the reactor for about 8 more hours to concentrate the latex. It produced a solid content of 15.5%. The particle diameter of the latex as determined by PCS was 62 nm.

EXAMPLES 13-21

PCP Dispersion of Magenta Coupler (C-6) and Their Photographic Behavior

Preparation of the Dispersions

The control microprecipitated dispersion (prior art (R-22)) of coupler (C-6) of Example-13 was prepared using the equipment of FIG. 1 with the composition as described in Table IV as follows:

The process utilizes the semicontinuous pH-controlled coupler precipitation process described in (R-22). This apparatus produced about 800 ml of dispersion.

| | | |
|---|---|---|
| Coupler solution: | Coupler C-6 | 20 g |
| | 20% NaOH | 5 g |
| | n-propanol | 50 g |
| | | 75 g |

Above ingredients were mixed together and heated to 60° C. with stirring to dissolve the coupler and then cooled to room temperature in a separate vessel (not shown) in FIG. 1 and added to the coupler kettle 100.

| | | |
|---|---|---|
| Surfactant solution: | Distilled water | 500 g |
| | Surfactant (I-1) | 3 g |
| | | 503 g |

Above ingredient added in the reaction kettle 104 of FIG. 1 and stirred to mix. The acid kettle filled with 15% propionic acid. Stirrer 116 was maintained at 2000 rpm. The basic coupler solution was pumped into the reaction kettle at 20 mg/min. The ph-controller was set at 6.0, which controlled the pH by turning the acid pump on as the pH went over 6.0, and off as the pH fell below 6.0. In effect, pH was controlled to 6.0±2 as determined the strip chart recorder 130. Precipitation was carried out at room temperature. After precipita-

TABLE IV

Preparation of PCP Dispersions of Coupler (C-6)

| | Coupler Solution | | | | Surfactant/Polymer Solution | | | | | |
|---|---|---|---|---|---|---|---|---|---|---|
| Example | Coupler Wt. (g) | Normal Propanol Wt. (g) | 20% NaOH | Dissolution Temp. °C. | Surfactant | Surfactant Wt. (g) | Polymer | Dry Wt. of Polymer (g) | Final Wt. of Surfactant/Polymer Sol. (g) | 50% NaOH (g) |
| 13 | 20 | 50 | 5 | 45 | SDS[1] | 3 | None | 0 | 500 | 1.5 |
| 14 | 20 | 50 | 5 | 45 | SDS | 3 | AB (80/20) Example-8 | 5 | 500 | 1.5 |
| 15 | 20 | 50 | 5 | 45 | SDS | 3 | AB (80/20) Example-8 | 10 | 500 | 1.5 |
| 16 | 20 | 50 | 5 | 45 | SDS | 3 | AB (80/20) Example-8 | 20 | 500 | 1.5 |
| 17 | 20 | 50 | 5 | 45 | SDS | 3 | AB (80/20) Example-8 | 40 | 500 | 1.5 |
| 18 | 20 | 50 | 5 | 45 | SDS | 3 | AB (95/5) Example-7 | 5 | 500 | 1.5 |
| 19 | 20 | 50 | 5 | 45 | SDS | 3 | AB (95/5) Example-7 | 10 | 500 | 1.5 |
| 20 | 20 | 50 | 5 | 45 | SDS | 3 | AB (95/5) Example-7 | 20 | 500 | 1.5 |
| 21 | 1408 | 3521 | 352 | 45 | SDS | 211 | AB (80/20) Example-11 | 1425 | 35207 | 106 |

| | Particle Diameter (nm) by PCS | | % Higher Green | |
|---|---|---|---|---|
| Example | Initial | 40 Days at Room Temperature | D-max Over Conv. Control | Comments |
| 13 | 15 | 27 | 11.3 | Small Particle Dispersion (small scale) control |
| 14 | 102 | 102 | 24.3 | PCP (small scale) |
| 15 | 104 | — | 25.2 | PCP (small scale) |
| 16 | 106 | 107 | 29.6 | PCP (small scale) |
| 17 | 126 | — | 20.9 | PCP (small scale) |
| 18 | 92 | 90 | 20.9 | PCP (small scale) |
| 19 | 87 | 89 | 24.3 | PCP (small scale) |
| 20 | 80 | 81 | 26.1 | PCP (small scale) |
| 21 | 96 | — | 29.6 | PCP (pilot scale) |

[1]Sodium dodecyl sulfate. Surfactant (I-1)

tion the resultant dispersion was washed by dialysis against distilled water for 24 hours. The dispersion gave a particle diameter of 15 nm by photon correlation spectroscopy.

The PCP dispersions of Examples 14-21 were prepared using the small scale equipment of FIG. 1. The preparation conditions of these dispersions are shown in Table IV. The coupler solutions were prepared by adding the propanol, 20% NAOH to the coupler. The mixture was heated to 45° C. to dissolve the coupler. After dissolution the solution was cooled to room temperature. The surfactant/polymer solution was prepared by adding the surfactant, 1.5 mil of 50% NAOH solution to make a final weight of 500 g and placed in container 104 of the equipment of FIG. 1. The coupler solution was placed in the container 100 of FIG. 1 and the neutralizing 15% propionic acid solution was placed in container 96 of FIG. 1. First, the coupler solution was pumped into the surfactant solution under agitation at a flow rate of 24 ml/min using pump 112. Then, 30 cc of propionic acid was pumped into the reaction vessel 116 of a rate of 24 ml/min using pump 108, with agitation. The formed dispersions were dialyzed against distilled water for 26 hours to remove the salts and the solvent. The dispersions were then analyzed for coupler content by high pressure liquid chromatography and for particle size by photon correlation spectroscopy. Such small scale PCP dispersions typically contained 2% coupler by weight. It was found that use of the cross-linked polymer of Example 10 led to coagulation of the system during preparation of the PCP dispersions indicating that cross-linked particles do not favor precipitation of the coupler inside the polymer particle, Therefore, cross-linked polymer particles such as in Example 10 was not used for any further experimentation.

The Pilot Scale PCP dispersion (Example-21) of compound (C-6), which is the magenta coupler of Kodak Ektacolor Paper, was prepared using the equipment of FIG. 2. The coupler solution, surfactant/polymer solution, and acid solution are prepared as follows:

| | | |
|---|---|---|
| Coupler solution: | Coupler C-6 | 1408 g |
| | 20% NaOH | 352 g |
| | n-propanol | 3521 g |
| | | 5281 g |
| | Flow rate: | 300 g/min. |

Above ingredients were mixed together and heated to 45° C. to dissolve the coupler and then cooled to 30° C. before use.

| | | |
|---|---|---|
| Surfactant/Polymer Solution (Example-11) | Polymer AB (80/20) (9.4% polymer in water) | 15000 g |
| | SDS (I-1) | 211 g |
| | 50% NaOH | 106 g |
| | High Purity Water | 19890 g |
| | | 35207 g/min |
| | Flow rate: | 2000 g/min |
| Acid Solution: | Propionic acid | 375 g |
| | High Purity Water | 2125 g |
| | | 2500 g |
| | Flow rate: | Approximately 80 g/min (adjusted to control the pH of the dispersion between 5.9 to 6.1). |

The description of the apparatus set up for this example is as follows:

Temperature-controlled, open-top vessels.

Gear pumps with variable-speed drives.

The mixer is a high fluid shear centrifugal mixer operated with a typical residence time of about 2 sec.

A SWAGE-LOC "T" fitting where surfactant and coupler streams join.

Residence time in pipe between T-fitting and mixer is <1 sec.

In-line pH probe is used to monitor pH in the pipe exiting the mixer.

Positive displacement pump for recirculation in batch ultrafiltration.

Ultrafiltration membrane is OSMONICS 20 K PS 3' by 4" spiral-wound permeator.

Process Description

The three solutions are continuously mixed in the high-speed mixing device in which the ionized and dissolved coupler is reprotonated causing the precipitation of the coupler into polymer particles. The presence of the surfactant stabilized the formed dispersion particles. The salt by-product of the acid/base reaction is sodium propionate. Ultrafiltration is used for constant-volume washing with distilled water to remove the salt and the solvent (n-propanol) from the crude dispersion. The recirculation rate is approximately 20 gal/min with 50 psi back pressure which gives a permeate rate of about 1 gal/min. The washed dispersion is also concentrated by ultrafiltration to the desired final coupler concentration of about 10 weight percent. The time to perform the ultrafiltration and produce the final coupler concentration is about 1 hour. Average particle size was 104 nm as measured by photon correlation spectroscopy (PCS).

Demonstration of the Imbibition of the Coupler Inside the Polymer Particles

Electron photomicrography of such PCP dispersions appear to show latex like particles, with narrow size distribution. Glassy films of such dispersions could be prepared by evaporating them in an aluminum pan in a hood for a period of about 48 hours. When such transparent glassy films were analyzed for thermal transitions using a differential scanning calorimeter (DSC), single second order glass transitions were observed. The glass transition temperature (Tg) for all the dried PCP dispersions were measured to be somewhere in between the Tg values of the dried polymer and the coupler itself. FIG. 5 shows a plot of the Tg values of the dried PCP dispersions made with AB (95/5) and AB (80/20) polymers. It appears that they both follow a monotonic trend from the Tg value of the parent polymer to that of the imbibed coupler. If the precipitation process leads to true incorporation of the coupler into the polymer particle, it is expected that with the increased incorporation of the coupler into the particle, the Tg values should approach that of the coupler, starting from that of the free polymer. This observation and that all the PCP dispersions showed single thermal glass transition indicates clearly that the coupler molecules are indeed precipitated inside the polymer particles.

Photographic Evaluations

For photographic evaluation of such PCP dispersions, dispersion of Example-20 was coated in a magenta monochrome Ektacolor Paper coating format (described earlier in Example-5). Fresh sensitometry indicated identical green D-min and photographic speeds but 12% higher green D-max compared to a coating that contained the conventional milled dispersion of Example-2 that contained coupler solvent. Since paper is coated on reflection support, the reflection dye density levels off as a function of dye coverage due to optical effects. Therefore, in order to determine the maximum advantage in dye density yield that can be achieved from PCP dispersions, the dispersions of Examples 13–21 were coated in the same magenta monochrome format except silver coverage was cut down by a half to be in a region where the image density is not reflection limited. In FIG. 8 is plotted the % larger dye density yield compared to a coating containing conventional dispersion (Example-1) of coupler (C-11). It is observed that all the PCP dispersions of Examples 14–21 showed at least 20% higher dye density yield compared to the coating containing the conventional dispersion and also at least 10% higher dye density yields compared to the small particle dispersions of prior art (Example-13) that contain no polymer. It is also seen that maximum dye density yield is obtained at an intermediate loading of 50% coupler and 50% polymer, which is a preferred embodiment of the invention. Such large dye density advantages can lead to very large cost savings in consumer products such as Ektacolor Paper. It is also seen in Table IV that even after 40 days storage at room temperature (Examples 14, 16, 18, 19, and 20), there was no particle size growth of the dispersions which indicates excellent stability of the PCP dispersions.

Unlike the small particle dispersions of prior art (Example-13), no viscosity problems were encountered during coating of this material especially in the case of the concentrated pilot plant dispersion of Example-21.

EXAMPLES 22–28

PCP Dispersions of Coupler (C-1) and Their Photographic Behaviors

Preparation of Dispersions

The control microprecipitated dispersion (prior art (R-22)) of coupler (C-1) of Example 22 was prepared using the equipment of FIG. 1, with the composition as described in Table V as follows:

TABLE V

Preparation of PCP Dispersions of Coupler (C-1)

| | Coupler Solution | | | | Surfactant/Polymer Solution | | | | | |
|---|---|---|---|---|---|---|---|---|---|---|
| Example | Coupler Wt. (g) | Normal Propanol Wt. (g) | 20% NaOH | Dissolution Temp. °C. | Surfactant | Surfactant Wt. (g) | Polymer | Dry Wt. of Polymer (g) | Final Wt. of Surfactant/Polymer Sol. (g) | 50% NaOH (g) |
| 22 | 20 | 50 | 5 | 60 | SDS[1] | 3 | None | 0 | 500 | 1.5 |
| 23 | 20 | 50 | 5 | 60 | SDS | 3 | AB (80/20) Example-8 | 5 | 500 | 1.5 |
| 24 | 20 | 50 | 5 | 60 | SDS | 3 | AB (80/20) Example-8 | 10 | 500 | 1.5 |
| 25 | 20 | 50 | 5 | 60 | SDS | 3 | AB (80/20) Example-8 | 20 | 500 | 1.5 |
| 26 | 20 | 50 | 5 | 60 | SDS | 3 | AB (80/20) Example-8 | 40 | 500 | 1.5 |
| 27 | 20 | 50 | 5 | 60 | SDS | 3 | AB (95/5) Example-7 | 20 | 500 | 1.5 |
| 28 | 1400 | 3500 | 350 | 60 | SDS | 210 | AB (95/5) Example-12 | 1400 | 35000 | 105 |

| | Particle Diameter (nm) by PCS | | |
|---|---|---|---|
| Example | Initial | 40 Days at Room Temperature | Comments |
| 22 | 10 | 20 | Small Particle Dispersion (or small scale) control |
| 23 | 100 | 102 | PCP (small scale) |
| 24 | 107 | — | PCP (small scale) |
| 25 | 106 | 106 | PCP (small scale) |
| 26 | 162 | — | PCP (small scale) |
| 27 | 81 | 86 | PCP (small scale) |
| 28 | 111 | — | PCP (small scale) |

[1]Sodium dodecyl sulfate. Surfactant (S-1)

The process utilizes the semicontinuous pH-controlled coupler precipitation process described (R-22). This apparatus produced about 700–800 ml of dispersion.

| | | |
|---|---|---|
| Coupler solution: | Coupler (C-1) | 20 g |
| | 20% NaOH | 5 g |
| | n-propanol | 50 g |
| | | 75 g |

Above ingredients mixed together and heated to 60° C. with stirring to dissolve the coupler and then cooled to room temperature in a separate vessel (not shown) in FIG. 4 and added to the coupler kettle 100.

| | | |
|---|---|---|
| Surfactant solution: | Distilled water | 500 g |
| | Surfactant (I-1) | 3 g |
| | | 503 g |

Above ingredient added in the reaction kettle 104 of FIG. 4 and stirred to mix. The acid kettle filled with 15% propionic acid. Stirrer 116 was maintained at 2000 rpm. The basic coupler solution was pumped into the reaction kettle at 20 mg/min. The ph-controller was set at 6.0, which controlled the pH by turning the acid pump on as the pH went over 6.0, and off as the pH fell below 6.0. In effect, pH was controlled to 6.0±2 as determined the strip chart recorder 130. Precipitation was carried out at room temperature. After precipitation the resultant dispersion was washed by dialysis against distilled water for 24 hours. The dispersion gave a particle diameter of 10 nm by photon correlation spectroscopy.

The small scale invention dispersions of Examples 23–28 were prepared in the same manner as those of Examples 14–21. The final concentration of coupler in these dispersions was about 2% with particle diameters of about 100 nm. The specific component amounts and the condition for these preparations are listed in Table V. It is also observed in the case of all the inventive (C-1) dispersions, that no particle size growth was observed over a room temperature keeping of 40 days.

The Pilot Scale inventive dispersion (Example-28) if compound (C-1), which is the yellow coupler of Kodak Ektacolor Paper, was prepared using the equipment of FIG. 2.

The coupler solution, surfactant solution, and acid solution are prepared as follows:

| | | |
|---|---|---|
| Coupler solution: | Coupler C-1 | 1400 g |
| | 20% NaOH | 350 g |
| | n-propanol | 3500 g |
| | | 5250 g |
| | Flow rate: | 300 g/min. |

Above ingredients were mixed together and heated to 60° C. to dissolve the coupler and then cooled to 30° C. before use.

| | | |
|---|---|---|
| Surfactant/Polymer Solution (Example-16) | Polymer AB (95/5) (15.5% polymer in water) | 9030 g |
| | SDS (I-1) | 210 g |
| | 50% NaOH | 105 g |
| | High Purity Water | 25655 g |
| | | 35000 g/min |
| | Flow rate: | 2000 g/min |
| Acid Solution: | Propionic acid | 375 g |
| | High Purity Water | 2125 g |
| | | 2500 g |
| | Flow rate: | Approximately 80 g/min (adjusted to control the pH of the dispersion between 5.9 to 6.1). |

The apparatus and process description are the same as that for Example-21. The average particle diameter as measured by PCS was 111 nm.

Thermal Transition Properties

The thermal properties of the dried invention dispersions of compound (C-1) are shown in FIG. 7. Just as in the case of compound (C-11), the thermal properties of the dried (C-1) PCP dispersions indicated that they formed a homogeneous mixture of the coupler in the particles with a single glass transition temperature that increased monotonically as the coupler concentration increased in the particle from that of the free polymer to that of the glassy coupler.

Photographic Evaluation

For photographic evaluation of the (C-1) invention dispersions, dispersion of Example-27 was coated in a yellow monochrome Kodak Model Ektacolor Paper coating format with full UV protection layers (see Example-1). The control was coated using milled dispersion of coupler C-1 of Example-1 containing coupler solvent. The PCP dispersion was coated at 17% less coupler and 17% less silver compared to the control. Both the coatings gave virtually the same sensitometric curve, which indicates that the PCP dispersion of Example-27 can provide 17% Ag and 17% coupler savings. Such savings in consumer products, such as Ektacolor Paper and Eastman Color Print, can produce considerable cost reduction.

Dye Stability Evaluation

Coatings of Example-27 with the conventional control coatings (Example-6) was processed by a RA4 process (R-19) and exposed to 50 K lux exposure with light source balanced for about 4000° Kelvin for color temperature for 2 weeks and 4 weeks at ambient temperature and at ambient relative humidity. The PCP coatings showed about one-third the density loss of the control coatings, from a standard blue density of 1.7. This indicated that the PCP coatings provide very high stability of the dye compared to a conventional dispersion. Such increased dye stability is very important for competitive advantage in the color paper market.

EXAMPLES 29–34

Dispersion of Cyan Coupler (C-11)

Compound (C-11) is a very crystal prone material. In other words it crystallizes very readily when a dispersion is made out of it. If precipitated dispersions are made with it in the same procedure as those for compounds (C-6) and (C-1), crystallization within 2–3 days was observed. Such crystallized dispersions are not suitable for use in photographic coatings. However, if precipitated dispersions of (C-11) are made in the same procedure as those for compounds (C-6) and (C-1) and 0.25 g of polyvinylpyrrolidone (PVP) is added to the dispersion using an aqueous solution of it, the crystallization was virtually stopped and a very small particle growth was observed for a keeping of 40 days at room temperature. The formulation of such dispersions of compound (C-11) are described in Table VI.

TABLE VI

Preparation of PCP Dispersions of Coupler (C-11)

| | Coupler Solution | | | | Surfactant/Polymer Solution | | | | | |
|---|---|---|---|---|---|---|---|---|---|---|
| Example | Coupler Wt. (g) | Normal Propanol Wt. (g) | 20% NaOH | Dissolution Temp. °C. | Surfactant | Surfactant Wt. (g) | Polymer | Dry Wt. of Polymer (g) | Final Wt. of Surfactant/Polymer Sol. (g) | 50% NaOH (g) |
| 29 | 20 | 50 | 5 | 50 | SDS | 3 | AB (95/5) | 20 | 500 | 1.5 |

TABLE VI-continued

| Preparation of PCP Dispersions of Coupler (C-11) | | | | | | | | | | |
|---|---|---|---|---|---|---|---|---|---|---|
| | | | | | | | Example-7 | | | |
| 30 | 20 | 50 | 5 | 50 | SDS | 3 | None | 0 | 500 | 1.5 |
| 31 | 20 | 50 | 5 | 50 | SDS | 3 | AB (80/20) Example-8 | 5 | 500 | 1.5 |
| 32 | 20 | 50 | 5 | 50 | SDS | 3 | AB (80/20) Example-8 | 10 | 500 | 1.5 |
| 33 | 20 | 50 | 5 | 50 | SDS | 3 | AB (80/20) Example-8 | 20 | 500 | 1.5 |
| 34 | 20 | 50 | 5 | 50 | SDS | 3 | AB (80/20) Example-8 | 40 | 500 | 1.5 |

| Example | Particle Diameter (nm) by PCS Initial | 40 Days at Room Temperature | Comments |
|---|---|---|---|
| 29 | 87 | 93 | PCP (small scale) |
| 30 | 186 | 203 | Small Particle Control (small scale) |
| 31 | 100 | 140 | PCP (small scale) |
| 32 | 86 | — | PCP (small scale) |
| 33 | 78 | 81 | PCP (small scale) |
| 34 | 98 | — | PCP (small scale) |

To all these dispersions, after preparation was added 25 mL of 20% polyvinyl pyrrilodone (PVP) solution, for prevention of crystallization.

The control microprecipitated dispersion of coupler (C-11) of Example-30 was prepared using the equipment of FIG. 1. The process utilizes the semicontinuous ph-controlled coupler precipitation process. Produced is about 800 ml of dispersion.

| | | |
|---|---|---|
| Coupler solution: | Coupler (C-11) | 20 g |
| | 20% NaOH | 5 g |
| | n-propanol | 50 g |
| | | 75 g |

Above ingredients mixed together and heated to 60° C. with stirring to dissolve the coupler and then cooled to room temperature in a separate vessel (not shown) in FIG. 4 and added to the coupler kettle 100.

| | | |
|---|---|---|
| Surfactant solution: | Distilled water | 500 g |
| | Surfactant (I-1) | 3 g |
| | 20% PVP in water | 25 g |
| | | 528 g |

Above ingredient added in the reaction kettle 104 of FIG. 4 and stirred to mix. The acid kettle filled with 15% propionic acid. Stirrer 116 was maintained at 2000 rpm. The basic coupler solution was pumped into the reaction kettle at 20 mg/min. The ph-controller was set at 6.0, which controlled the pH by turning the acid pump on as the pH went over 6.0, and off as the pH fell below 6.0. In effect, pH was controlled to 6.0±2 as determined by the strip chart recorder 130. Precipitation was carried out at room temperature. After precipitation the resultant dispersion was washed by dialysis against distilled water for 24 hours. The dispersion gave a particle diameter of 186 rim by photon correlation spectroscopy. This is rather large size for prior art microprecipitated dispersions. Such large particle was formed because of the unusual growth behavior of coupler (C-11). It is seen in Table VI that in spite of this addition of PVP, some particle growth was observed in all the dispersions upon keeping at room temperature for 40 days.

Even though no pilot scale preparation of PCP dispersion of coupler (C-11) was made, as indicated earlier, provision was made to add the PVP solution via "T"-mixer 46 in the pilot equipment of FIG. 2. Thermal analysis of all the dried PCP dispersions show single glass transition temperatures and as shown in FIG. 8. Normal gradually increasing Tg values of the dried PCP films were observed as a function of increasing incorporation of the coupler. The thermograms confirmed that no separate coupler crystal phase existed in the PCP dispersions.

These dispersions were not tested photographically in color paper format. However, similar results as those of couplers (C-6) and (C-1) is expected.

The invention has been described in detail with particular reference to preferred embodiments thereof, but it will be understood that variations and modifications can be effected within the spirit and scope of the invention.

What is claimed is:

1. A composition comprising particles consisting of a hydrophobic photographic component that can be solubilized by base and solvent, surfactant, and a base ionizable latex polymer said latex polymer has a glass transition temperature less than 50° C., and is swellable by base.

2. The composition of claim 1 wherein said polymer contains at least 5% by weight of monomer that comprise at least one pendent carboxylic acid group.

3. The composition of claim 1 wherein the polymer contains at least 5% by weight of methacrylic acid.

4. The composition of claim 1 wherein the polymer is poly(butylacrylate-co-methacrylic acid) in the weight ratio between 70% and 30% to 95% to 5%.

5. The composition of claim 1 wherein said photographic component consists of at least one member selected from the group comprising dye-forming coupler, UV absorbers, reducing agents, nucleators, boosters, and developing agents.

6. The composition of claim 1 wherein said photographic component consists of a dye-forming coupler material selected for at least one of the following:

C-1
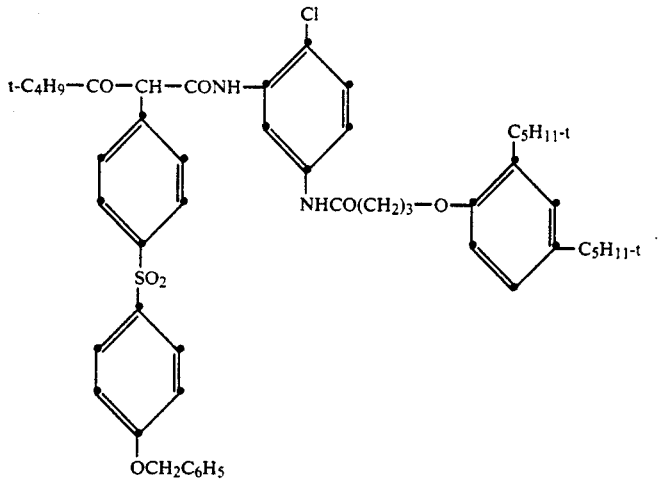
C-2
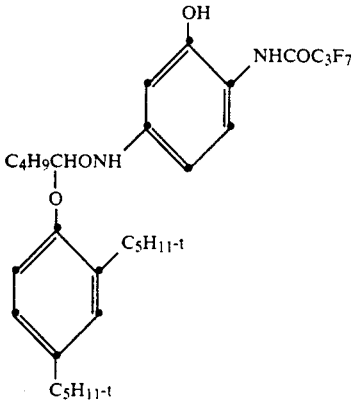
C-3
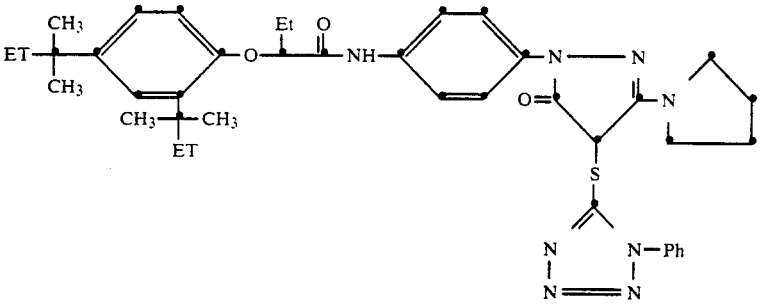
C-4
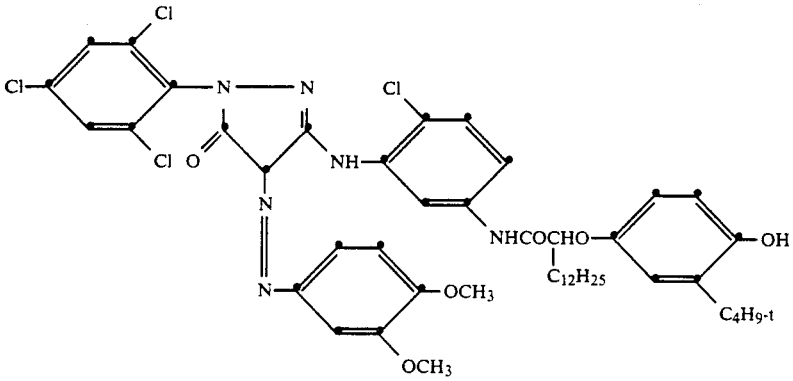

-continued
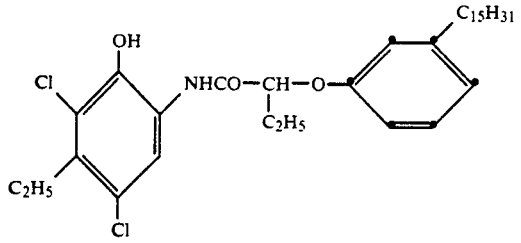
C-5
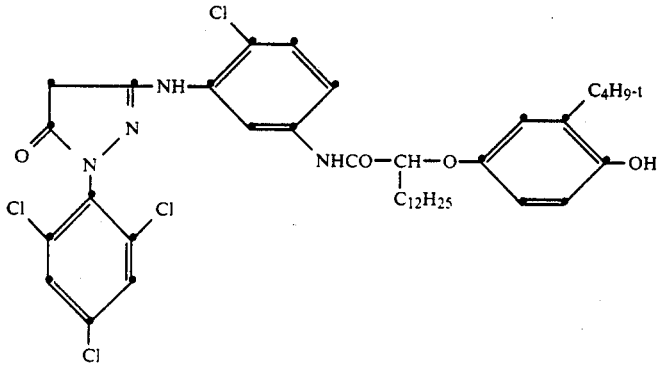
C-6
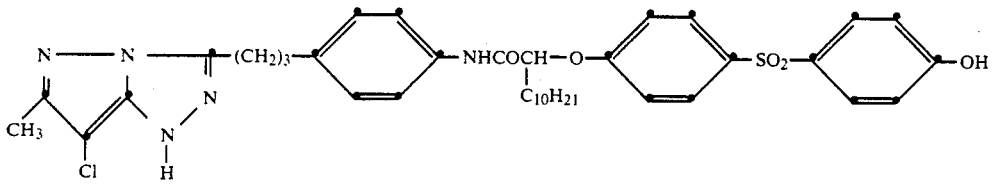
C-7
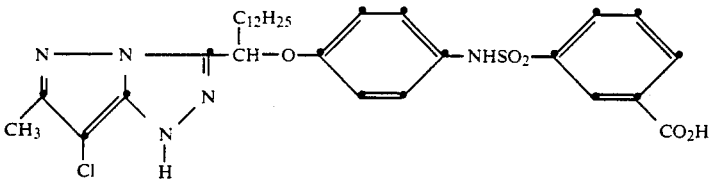
C-8
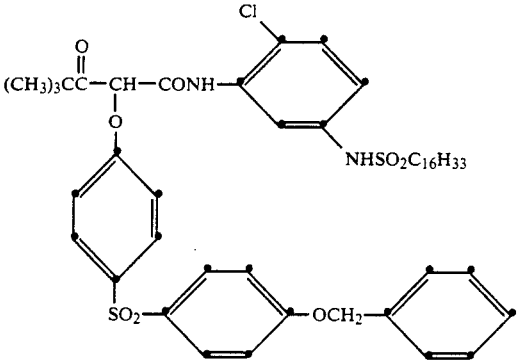
C-9

-continued
C-10
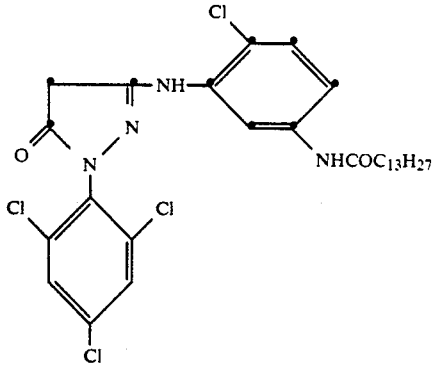
C-11
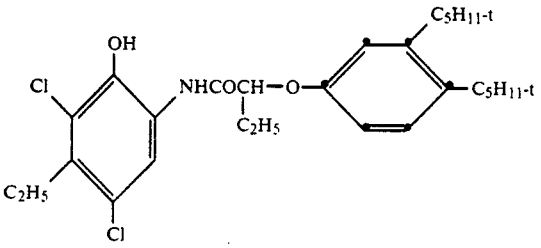
C-12
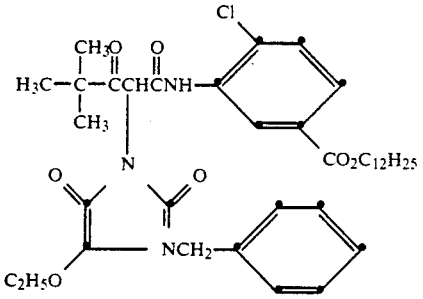
C-13
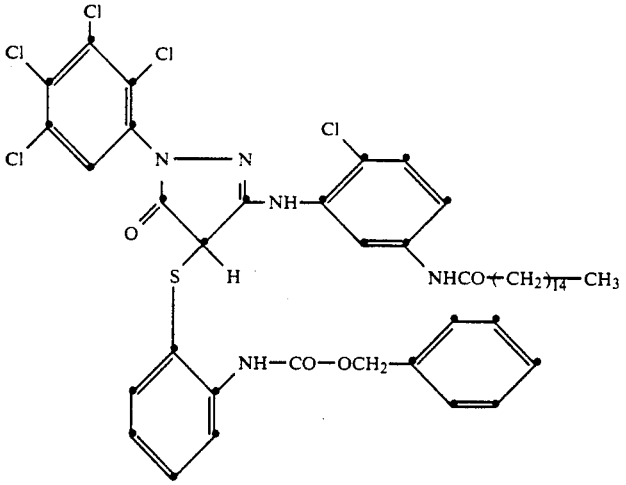
C-14
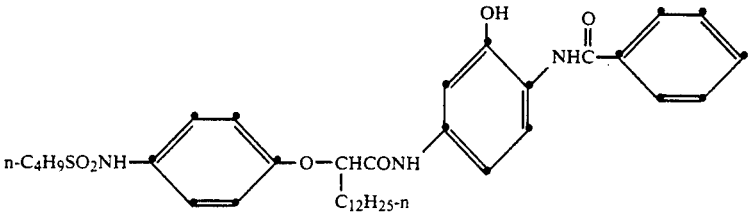

-continued

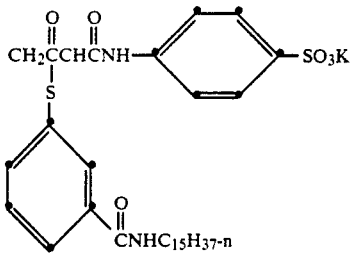

C-15

7. The composition of claim 6 wherein said surfactant comprises at least one of:

$CH_3-(CH_2)_{11}-SO_4^-Na^+$ (Sodium Dodecyl Sulfate)

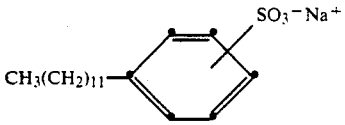

(Sodium Dodecyl Benzene Sulfonate)

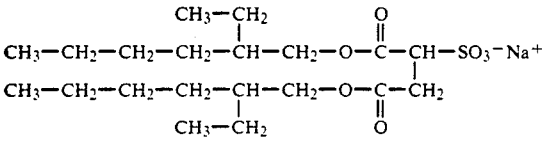

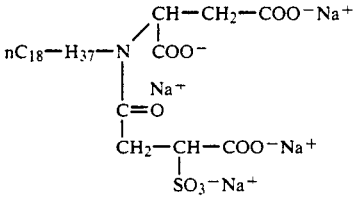

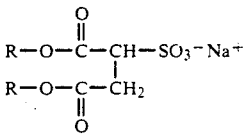

where $R = CH(CH_3)C_4H_9$

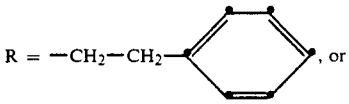

, or

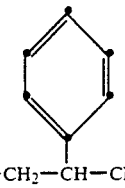

$R = -CH_2-CH-CH_3$, or $R = -CH_2-CH(CH_2CH_3)C_3H_7$

-continued

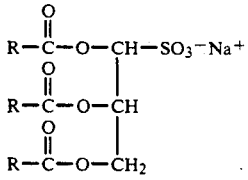

$R = -(CH_2)_nCH_3$(n = 2, 3 & 5), or $R = -(CH_2)_n-$ 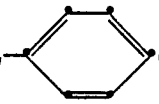 (n = 2 to 5)

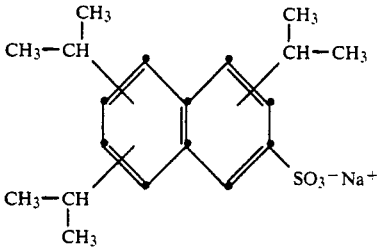

8. The composition of claim 6 wherein said surfactant comprises at least one of the following classes:

Class I—Surfactants with single, double, or triple $C_5$ to $C_{25}$ hydrocarbon chain terminated with one or more charged head groups and optionally provide with polymeric or oligomeric steric stabilizers comprising water soluble polymers and block oligomeric compounds comprising hydrophobic polyoxypropylene blocks (A) and hydrophilic polyoxyethylene blocks (B) joined in the manner of A—B—A, B—A—B, A—B, $(A-B)_n \equiv G \equiv (-B-A)_n$, or $(B-A)_n \equiv G \equiv (A-B)_n$, where G is a connective organic moiety and n is between 1 and 3

Class II—Surfactants comprising between 6 to 22 carbon atom hydrophobic tail with one or more attached hydrophilic chains comprising at least four oxyethylene and/or glycidyl ether groups that may or may not be terminated with a negative charge such as a sulfate group, and Class III—Sugar surfactants, comprising between one and three 6 to 22 carbon atom hydrophobic tail with one or more attached hydrophilic mono or oligosaccharidic hydrophilic chains that may or may not be terminated by a negatively charged group such as a sulfate group.

9. The composition of claim 1 wherein said surfactant comprises at least one of

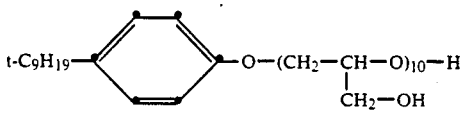
$n\text{-}C_{12}H_{25}-O-(CH_2-CH_2-O)_{12}-SO_3^-Na^+$
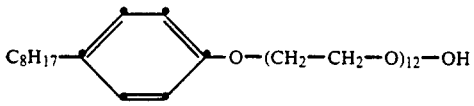
$n\text{-}C_{12}H_{25}-O-(CH_2-CH_2-O)_{23}-OH$
$C_{12}H_{25}-O-(CH_2-CH_2-O)_{15}-CH_2-CH_2-SO_3^-Na^3$
$n\text{-}C_{12}H_{25}-O-(CH_2-CH_2-O)_n-C(=O)-CH(CH_2-COO^-Na^+)-SO_3^-Na^+$
n = 3-5
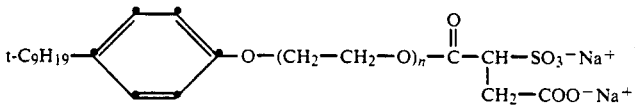
n = 5-10
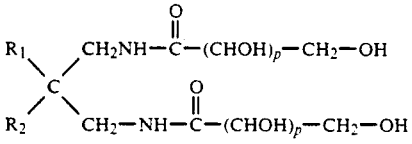
where, $R_1 = n\text{-}CH_3-(CH_2)_x-$ (where x = 3 to 10)
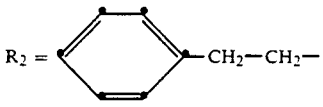
P = 3 to 10
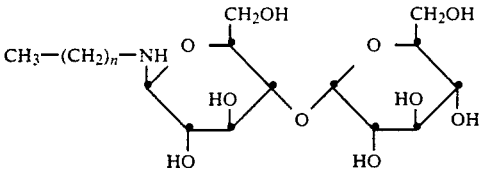
where, n = 3 to 15
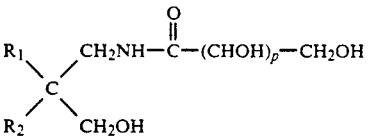
where, $R_1 = n\text{-}CH_3-(CH_2)_x-$ (where x = 3 to 10)
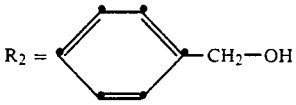
P = 3 to 15

-continued
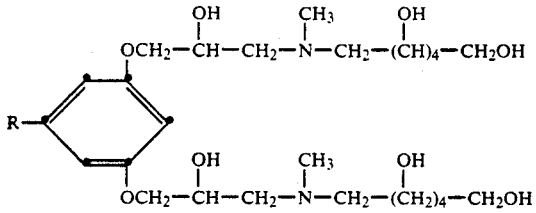
where, R = n-$CH_3$—$(CH_2)_x$—
(where, x = 1 to 5)
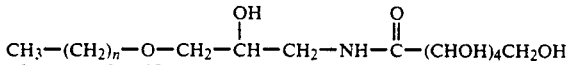
where, n = 3 to 15
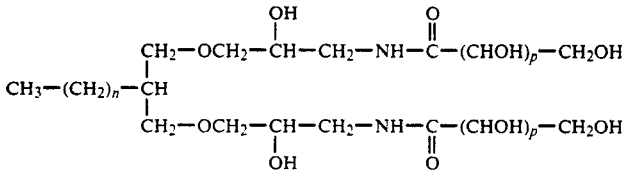
where, n = 2 to 12
p = 3 to 10
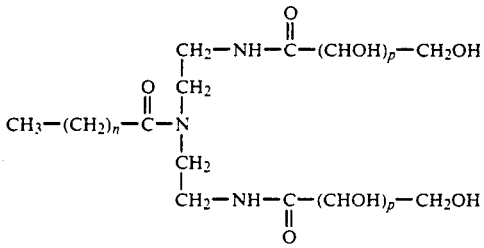
where, n = 2 to 18
p = 3 to 10
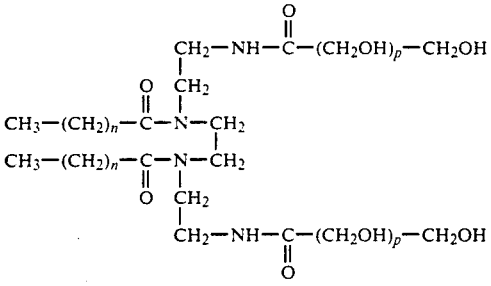
where, n = 2 to 18
p = 3 to 10
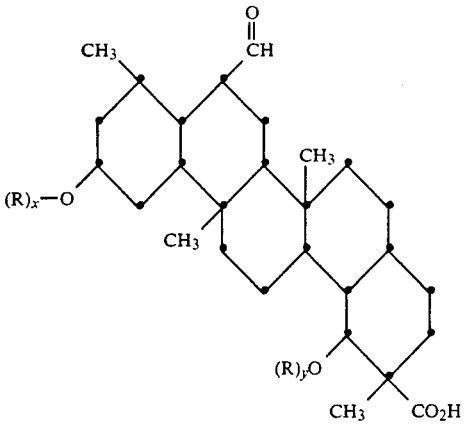
$(R)_x$, $(R)_y$ are polyglucosides -continued

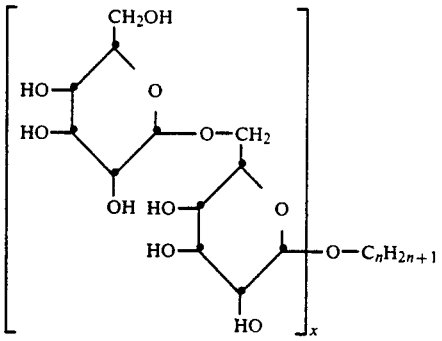

10. The composition of claim 1 wherein said photographic component consists of at least one member selected from the group of color dye-forming couplers, development inhibitor release couplers, development inhibitors, filter dyes, UV-absorbing dyes, development boosters, and development modifiers.

11. The composition of claim 7 wherein the polymer is poly(butylacrylate-co-methacrylic acid) in the weight ratio between 70% and 30% to 95% to 5%.

* * * * *

UNITED STATES PATENT AND TRADEMARK OFFICE

CERTIFICATE OF CORRECTION

PATENT NO. : 5,279,931
DATED : January 18, 1994
INVENTOR(S) : Pranab Bagchi, et al It is certified that error appears in the above-indentified patent and that said Letters Patent is hereby corrected as shown below:

Column 46, line 43, "provide" should read --provided--.

Signed and Sealed this

Thirty-first Day of May, 1994

Bruce Lehman

*Attest:*

BRUCE LEHMAN

*Attesting Officer*

*Commissioner of Patents and Trademarks*